US011763730B2

(12) United States Patent
Xu et al.

(10) Patent No.: US 11,763,730 B2
(45) Date of Patent: Sep. 19, 2023

(54) PIXEL DRIVING CIRCUIT HAVING AN INITIALIZATION AND COMPENSATION AND DISPLAY PANEL

(71) Applicants: Chengdu BOE Optoelectronics Technology Co., Ltd., Sichuan (CN); BOE TECHNOLOGY GROUP CO., LTD., Beijing (CN)

(72) Inventors: Yuanjie Xu, Beijing (CN); Benlian Wang, Beijing (CN); Yue Long, Beijing (CN); Yao Huang, Beijing (CN); Lili Du, Beijing (CN)

(73) Assignees: Chengdu BOE Optoelectronics Technology Co., Ltd., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 77 days.

(21) Appl. No.: 17/432,574

(22) PCT Filed: Nov. 11, 2020

(86) PCT No.: PCT/CN2020/128119

§ 371 (c)(1),
(2) Date: Aug. 20, 2021

(87) PCT Pub. No.: WO2022/099508

PCT Pub. Date: May 19, 2022

(65) Prior Publication Data

US 2022/0351671 A1 Nov. 3, 2022

(51) Int. Cl.
*G09G 3/32* (2016.01)

(52) U.S. Cl.
CPC ..... *G09G 3/32* (2013.01); *G09G 2310/0278* (2013.01)

(58) Field of Classification Search
CPC ..... G09G 3/32
(Continued)

(56) References Cited

U.S. PATENT DOCUMENTS

2018/0366062 A1 12/2018 Kim et al.
2021/0049959 A1* 2/2021 Park ..... G09G 3/325
2021/0225293 A1* 7/2021 Wang ..... G09G 3/3266

FOREIGN PATENT DOCUMENTS

CN 106531076 A 3/2017
CN 107767819 A 3/2018
(Continued)

*Primary Examiner* — Long D Pham
(74) *Attorney, Agent, or Firm* — HOUTTEMAN LAW LLC

(57) ABSTRACT

The disclosure provides a pixel driving circuit and a display panel, and belongs to the field of display technology. In the pixel driving circuit, the data write sub-circuit is configured to write a data voltage to a first electrode of the driving sub-circuit in response to a first scan signal; the auxiliary function sub-circuit is configured to compensate a threshold voltage of the driving transistor; the reset sub-circuit is configured to initialize a first electrode of the light emitting device to be driven in response to a reset control signal, and the second light emitting control sub-circuit transmits the initialization signal to a second electrode of the driving sub-circuit in response to a second light emitting control signal; the first light emitting control sub-circuit is configured to write a first power voltage to the first electrode of the driving transistor in response to a first light emitting control signal.

20 Claims, 20 Drawing Sheets

(58) Field of Classification Search
USPC ..... 345/76
See application file for complete search history.

(56) References Cited

FOREIGN PATENT DOCUMENTS

| | | | |
|---|---|---|---|
| CN | 109087610 | A | 12/2018 |
| CN | 111754920 | A | 10/2020 |
| KR | 20190113708 | A | 10/2019 |

* cited by examiner

PIXEL DRIVING CIRCUIT HAVING AN INITIALIZATION AND COMPENSATION AND DISPLAY PANEL

TECHNICAL FIELD

The present disclosure relates to the field of display technology, and in particular to a pixel driving circuit and a display panel.

BACKGROUND

With development and upgrading of display technology, organic electroluminance display devices (OLED) have become mainstream products in the display field due to their characteristics of self-luminescence, high brightness, high contrast, low operating voltage, and capability of manufacturing flexible displays.

SUMMARY

The present invention aims to solve at least one of technical problems in the prior art and provides a pixel driving circuit and a display panel.

In a first aspect, the embodiment of the present disclosure provides a pixel driving circuit, including: a data write sub-circuit, a driving sub-circuit, a reset sub-circuit, a first light emitting control sub-circuit, a second light emitting control sub-circuit, an auxiliary function sub-circuit and a storage sub-circuit; wherein, the driving sub-circuit includes a driving transistor configured to generate a driving current according to voltages at a first electrode and a control electrode of the driving transistor so as to drive a light emitting device to be driven;

in a data write and threshold compensation stage, the data write sub-circuit is configured to write a data voltage to a first electrode of the driving sub-circuit in response to a first scan signal; the auxiliary function sub-circuit is configured to compensate a threshold voltage of the driving transistor; the storage sub-circuit is configured to store the data voltage;

in an initialization stage, the auxiliary function sub-circuit is configured to connect a control electrode and a second electrode of the driving transistor; the reset sub-circuit is configured to initialize a first electrode of the light emitting device to be driven by an initialization signal in response to a reset control signal, and the second light emitting control sub-circuit transmits the initialization signal to a second electrode of the driving sub-circuit in response to a second light emitting control signal;

in a light emitting stage, the first light emitting control sub-circuit is configured to write a first power voltage to the first electrode of the driving transistor in response to a first light emitting control signal, such that the driving transistor generates the driving current; the second light emitting control sub-circuit is configured to transmit the driving current to the light emitting device to be driven in response to a second light emitting control signal.

wherein the auxiliary function sub-circuit includes: a first transistor and a second transistor;

a first electrode of the first transistor is connected to a second electrode of the second transistor, a second electrode of the first transistor is connected to the control electrode of the driving transistor, and the control electrode of the first transistor is connected to a first control signal line;

a first electrode of the second transistor is connected to the second electrode of the driving transistor, and a control electrode of the second transistor is connected to a second scan line.

wherein in a scan period of one frame image, the first control signal line is configured to write any one of:

an operating level signal;

a signal opposite to the first light emitting control signal;

a second scan signal.

wherein the auxiliary function sub-circuit includes: a first transistor and a second transistor;

a first electrode of the first transistor is connected to the second scan line, a second electrode of the first transistor is connected to a control electrode of the second transistor, and a control electrode of the first transistor is connected to a first control signal line;

a first electrode of the second transistor is connected to the second electrode of the driving transistor, and a second electrode of the second transistor is connected to the control electrode of the driving transistor.

wherein the first control signal line is configured to write a signal opposite to the first light emitting control signal or a second scan signal in a scan period of one frame image.

wherein the data write sub-circuit includes a fourth transistor;

a first electrode of the fourth transistor is connected to a data line, a second electrode of the fourth transistor is connected to the first electrode of the driving transistor, and a control electrode of the fourth transistor is connected to a first scan line.

wherein the first light emitting control sub-circuit includes: a fifth transistor;

a first electrode of the fifth transistor is connected to a first power voltage line, a second electrode of the fifth transistor is connected to the first electrode of the driving transistor, and a control electrode of the fifth transistor is connected to a first light emitting control line.

wherein the second light emitting control sub-circuit includes: a sixth transistor;

a first electrode of the sixth transistor is connected to the second electrode of the driving transistor, a second electrode of the sixth transistor is connected to the first electrode of the light emitting device to be driven, and a control electrode of the sixth transistor is connected to a second light emitting control line.

wherein the reset sub-circuit includes: a seventh transistor;

a first electrode of the seventh transistor is connected to the first electrode of the light emitting device to be driven, a second electrode of the seventh transistor is connected to an initialization signal line, and a control electrode of the seventh transistor is connected to a reset signal line.

wherein the storage sub-circuit includes: a storage capacitor;

a first electrode plate of the storage capacitor is connected to the control electrode of the driving transistor, and a second electrode plate of the storage capacitor is connected to the first power voltage line.

In a second aspect, the embodiment of the present disclosure provides a display panel including the above pixel driving circuit.

wherein the pixel driving circuits are arranged in an array; the auxiliary function sub-circuit includes a first transistor and a second transistor; a first electrode of the first transistor is connected to a second electrode of the second transistor, a second electrode of the first transistor is connected to the control electrode of the driving transistor, and a control electrode of the first transistor is connected to a first control signal line; a first electrode of the second transistor is connected to the second electrode of the driving transistor, and a control electrode of the second transistor is connected to a second scan line;

for the pixel driving circuits in a same row, respective data write sub-circuits are connected to a same first scan line; respective first light emitting control sub-circuits are connected to a same first light emitting control line; respective second light emitting control sub-circuits are connected to a same second light emitting control line; in respective auxiliary function sub-circuits, control electrodes of the first transistors are connected to a same first control signal line, and control electrodes of the second transistors are connected to a same second scan line; respective reset sub-circuits are connected to a same reset signal line;

for the pixel driving circuits in a same column, respective data write sub-circuits are connected to a same data line; respective first light emitting control sub-circuits and respective storage sub-circuits are connected to a same first power signal line; respective reset sub-circuits are connected to a same initialization signal line;

the first scan line connected to the pixel driving circuits in the (N+1)th row is multiplexed as the second scan line and the reset signal line connected to the pixel driving circuits in the Nth row; the first light emitting control line connected to the pixel driving circuits in the (N+1)th row is multiplexed as the second light emitting control line connected to the pixel driving circuits in the Nth row; N is an integer greater than or equal to 1.

wherein the first scan line to which the pixel driving circuits in the (N+1)th row are connected is further multiplexed as a first control signal line to which the pixel driving circuits in the Nth row are connected.

wherein the pixel driving circuits are arranged in an array; the auxiliary function sub-circuit includes a first transistor and a second transistor; a first electrode of the first transistor is connected to the second scan line, a second electrode of the first transistor is connected to a control electrode of the second transistor, and a control electrode of the first transistor is connected to a first control signal line; a first electrode of the second transistor is connected to the second electrode of the driving transistor, and the first electrode of the second transistor is connected to the control electrode of the driving transistor;

for the pixel driving circuits located in a same row, respective data write sub-circuits are connected to a same first scan line; respective first light emitting control sub-circuits are connected to a same first light emitting control line, respective second light emitting control sub-circuits are connected to a same second light emitting control line, and the gates of the first transistors in respective auxiliary function sub-circuits are connected to a same first control signal line; respective reset sub-circuits are connected to a same reset signal line; the sources of the first transistors in respective auxiliary function sub-circuits are connected to a same second scan line;

for the pixel driving circuits in a same column, respective data write sub-circuits are connected to a same data line; respective first light emitting control sub-circuits and respective storage sub-circuits are connected to a same first power signal line; respective reset sub-circuits are connected to a same initialization signal line;

the first scan line connected to the pixel driving circuits in the (N+1)th row is multiplexed as the second scan line and the reset signal line connected to the pixel driving circuits in the Nth row; the first light emitting control line connected to the pixel driving circuits in the (N+1)th row is multiplexed as the second light emitting control line connected to the pixel driving circuits in the Nth row; N is an integer greater than or equal to 1.

wherein the first scan line to which the pixel driving circuits in the (N+1)th row are connected is further multiplexed as a first control signal line to which the pixel driving circuits in the Nth row are connected.

DETAIL DESCRIPTION OF EMBODIMENTS

Figure 1:
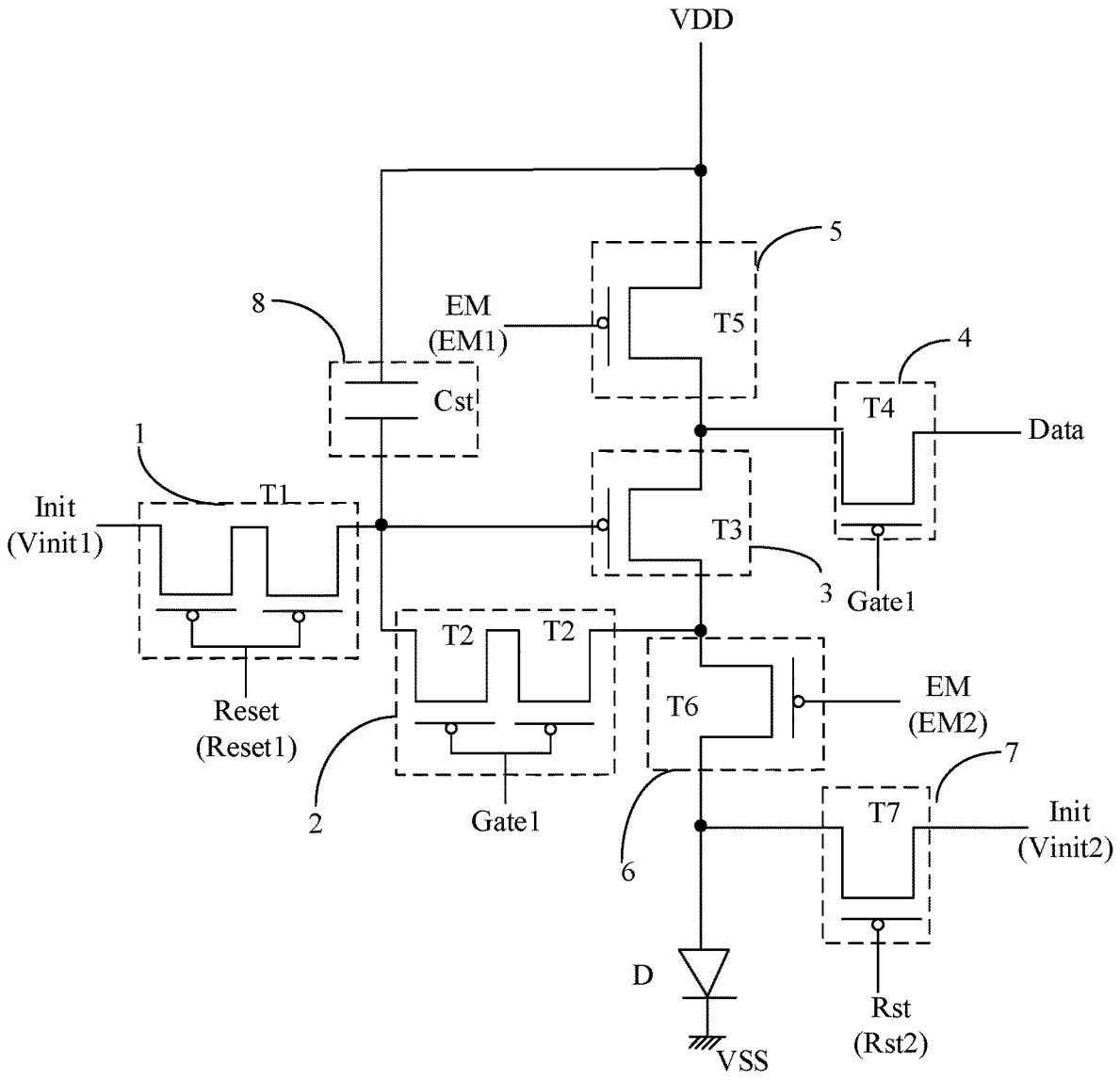
FIG. 1 is a schematic diagram of an exemplary pixel driving circuit.

To enable a person skilled in the art to better understand technical solutions of the present disclosure, the present disclosure will be further described in detail below with reference to the accompanying drawings and exemplary embodiments.

Unless defined otherwise, technical or scientific terms used herein should have the same meaning as commonly understood by one of ordinary skill in the art to which the present disclosure belongs. The terms of "first", "second", and the like herein are not intended to indicate any order, quantity, or importance, but rather are used for distinguishing one element from another. Further, the terms of "a", "an", "the", or the like used herein does not denote a limitation of quantity, but rather denote the presence of at least one element. The term of "comprising", "including", or the like, means that the element or item preceding the term contains the element or item listed after the term and the equivalent thereof, but does not exclude the presence of other elements or items. The terms "connected", "coupled", and the like are not limited to physical or mechanical connections, but may include electrical connections, whether direct or indirect connections. The terms "upper", "lower", "left", "right", and the like are used only for indicating relative positional relationships, and when the absolute position of an object being described is changed, the relative positional relationships may also be changed accordingly.

It should be noted that the transistors may be divided into N-type transistors and P-type transistors according to their characteristics. For clarity, in the embodiments of the present disclosure, the technical solution of the present disclosure will be described in detail by taking an example in which the transistors are P-type transistors (for example, P-type MOS transistors). However, the transistors in the embodiments of the present disclosure are not limited to P-type transistors, and a person skilled in the art may also implement functions of one or more transistors in the embodiments of the present disclosure by using N-type transistors (e.g., N-type MOS transistors) according to actual needs.

Transistors used in the embodiments of the present disclosure may be thin film transistors or field effect transistors or other switching devices with the same characteristics, and the thin film transistors may include oxide semiconductor thin film transistors, amorphous silicon thin film transistors or polysilicon thin film transistors, etc. Each transistor includes a first electrode, a second electrode and a control electrode; the control electrode is used as a gate of the transistor, one of the first electrode and the second electrode is used as a source of the transistor, and the other one is used as a drain of the transistor; the source and drain of the transistor may be symmetrical in structure, so that there may be no difference between the source and the drain in physical structure. In the embodiments of the present disclosure, in order to distinguish transistors, except for the gate serving as the control electrode, the first electrode is directly described as the source, and the second electrode is the drain, so that the source and the drain of all or part of the transistors in the embodiments of the present disclosure may be interchanged as necessary.

It should be understood that since the transistors used in the embodiments of the present disclosure are P-type transistors, an operating level signal corresponds to a low level signal, and a non-operating level signal corresponds to a high level signal.

In addition, a light emitting device in the embodiment of the present disclosure may be a micro inorganic light emitting diode, and further may be an electric current type light emitting diode, such as a micro light emitting diode (Micro LED) or a mini light emitting diode (Mini LED). Alternatively, the light emitting device in the embodiment of the present disclosure may also be an organic light emitting diode (OLED). One of a first electrode and a second electrode of the light emitting device is an anode, and the other is a cathode. The embodiment of the present invention will be described by taking an example in which the first electrode of the light emitting device is an anode, and the second electrode is a cathode.

FIG. 1 is a schematic diagram of an exemplary pixel driving circuit. As shown in FIG. 1, the pixel driving circuit includes a driving sub-circuit 3, a first light emitting control sub-circuit 5, a second light emitting control sub-circuit 6, a data write sub-circuit 4, a storage sub-circuit 8, a threshold compensation sub-circuit 2, a first reset sub-circuit 1, and a second reset sub-circuit 7. The driving sub-circuit 3 may be a driving transistor T3 configured to output a driving current to a light emitting device D to be driven according to a gate-source voltage Vgs.

The first light emitting control sub-circuit 5 is respectively connected to a first power voltage line VDD and a source of the driving transistor T3, and is configured to connect or disconnect the driving transistor T3 and a first voltage terminal VDD; and the second light emitting control sub-circuit 6 is respectively electrically connected to a drain of the driving transistor T3 and a first electrode D1 of the light emitting device D, and is configured to connect or disconnect the driving sub-circuit 3 and the light emitting device D. The data write sub-circuit 4 is electrically connected to the source of the driving transistor T3, and is configured to write a data signal into the storage sub-circuit 8 under the control of a first scan signal. The storage sub-circuit 8 is electrically connected to a gate of the driving transistor T3 and the first voltage terminal VDD, respectively, and is configured to store the data signal. The threshold compensation sub-circuit 2 is electrically connected to the gate and the drain of the driving transistor T3, respectively, and is configured to perform a threshold compensation on the driving transistor T3. The first reset sub-circuit 1 is electrically connected to the gate of the driving transistor T3, and is configured to reset the gate of the driving transistor T3 under the control of a first reset signal. The second reset sub-circuit 7 is electrically connected to the first electrode of the light emitting device D, and is configured to reset the first electrode of the light emitting device D under the control of a second reset control signal.

With continued reference to FIG. 1, the data write sub-circuit 4 includes a fourth transistor T4; the storage sub-circuit 8 includes a storage capacitor Cst; the threshold compensation sub-circuit 2 includes a second transistor T2; the first light emitting control sub-circuit 5 includes a fifth transistor T5; the second light emitting control sub-circuit 6 includes a sixth transistor T6; the first reset sub-circuit 1 includes a first transistor T1; and the second reset sub-circuit includes a seventh transistor T7.

Figure 2:
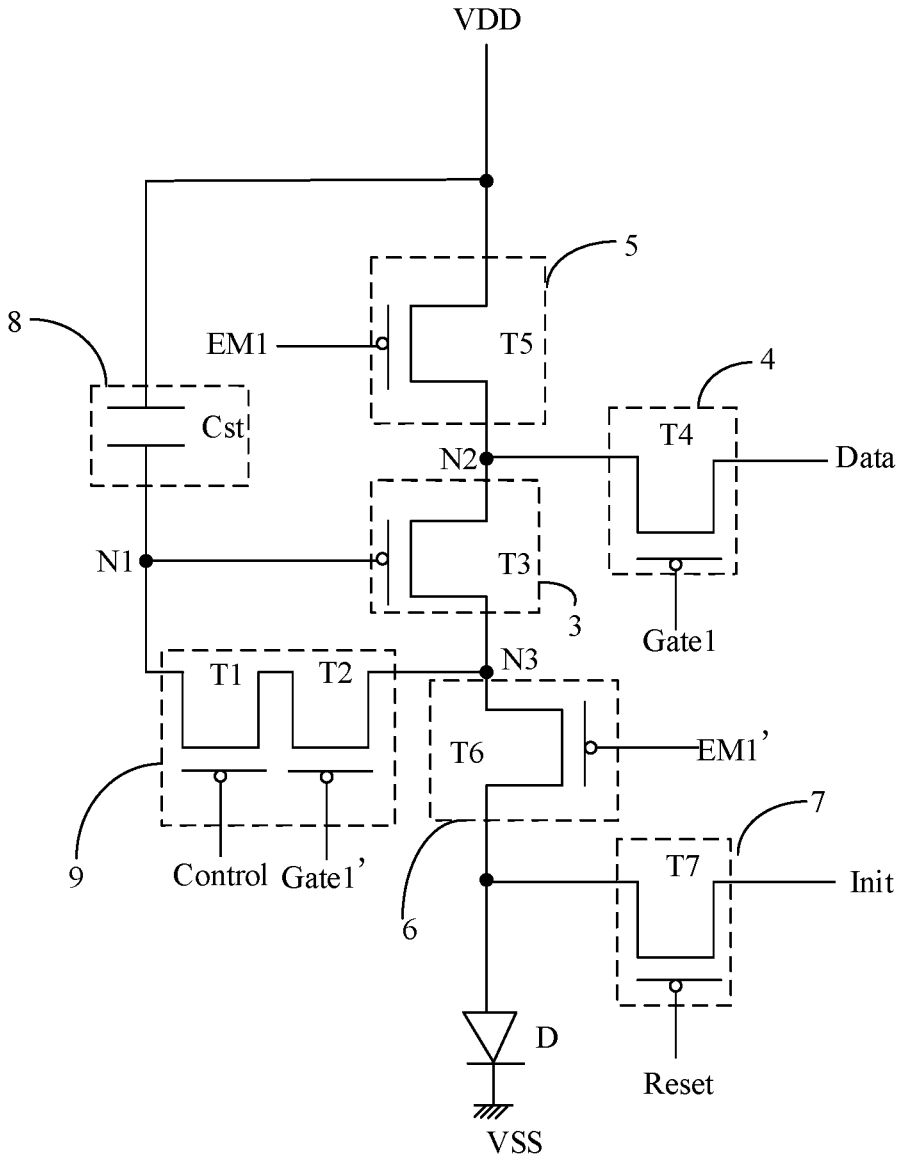
FIG. 2 is a schematic diagram of a pixel driving circuit according to an embodiment of the present disclosure.

With continued reference to FIG. 2, a drain of the fourth transistor T4 is electrically connected to the source of the driving transistor T3, a source of the fourth transistor T4 is configured to be electrically connected to a data line Data to receive a data signal, and a gate of the fourth transistor T4 is configured to be electrically connected to a first scan signal line Gate1 to receive the first scan signal; a first electrode plate of the storage capacitor Cst is electrically connected to the first power signal line VDD, and a second electrode plate of the storage capacitor Cst is electrically connected to the gate of the driving transistor T3; a source of the second transistor T2 is electrically connected to the drain of the driving transistor T3, a drain of the second compensation transistor T2 is electrically connected to the gate of the driving transistor T3, and a gate of the second compensation transistor T2 is configured to be electrically connected to a second scan signal line Gate2 to receive a compensation control signal; a source of the first transistor T1 is configured to be electrically connected to a first initialization signal line Vinit1 to receive a first initialization signal, a drain of the first transistor T1 is electrically connected to the gate of the driving transistor T3, and a gate of the first transistor T1 is configured to be electrically connected to a first reset control signal line Reset1 to receive a first reset control signal; a source of the seventh transistor T7 is configured to be electrically connected to a second initialization signal line Vinit2 to receive a second initialization signal, a drain of the seventh transistor T7 is electrically connected to the first electrode of the light emitting device D, and a gate of the seventh transistor T7 is configured to be electrically connected to a second reset control signal line Reset2 to receive a second reset control signal; a source of the fifth transistor T5 is electrically connected to the first power voltage line VDD, a drain of the fifth transistor T5 is electrically connected to the source of the driving transistor T3, and a gate of the fifth transistor T5 is configured to be electrically connected to a first light emitting control signal line EM1 to receive a first light emitting control signal; a source of the sixth control transistor T6 is electrically connected to the drain of the driving transistor T3, a drain of the sixth control transistor T6 is electrically connected to the first electrode of the light emitting device D, and a gate of the sixth control transistor T6 is configured to be electrically connected to a second light emitting control signal line EM2 to receive a second light emitting control signal; a second electrode of the light emitting device D is electrically connected to a second power voltage line VSS.

For example, one of the first power voltage line VDD and the second power voltage line VSS is connected to a high voltage terminal, and the other is connected to a low voltage terminal. For example, the first power voltage line VDD is a voltage source to output a constant first voltage, which is a positive voltage; and the second power voltage line VSS may be a voltage source to output a constant second voltage, which is a negative voltage, and so on. For example, in some examples, the second power voltage line VSS may be grounded.

With continued reference to FIG. 2, the scan signal and the compensation control signal may be the same. That is, the gate of the fourth transistor T4 and the gate of the second transistor T2 may be electrically connected to a same signal line, such as, the first scan signal line Gate1, to receive a same signal (such as, a scan signal), such that the display substrate may not be provided with the second scan signal line Gate2, thereby reducing the number of signal lines. Alternatively, the gate of the fourth transistor T4 and the gate of the second transistor T2 may be electrically connected to different signal lines, respectively. That is, the gate of the fourth transistor T4 is electrically connected to the first scan signal line Gate1, the gate of the second transistor T2 is electrically connected to the second scan signal line Gate2, and signals transmitted by the first scan signal line Gate1 and the second scan signal line Gate2 are the same.

It should be noted that the scan signal and the compensation control signal may not be the same, so that the gate of the fourth transistor T4 and the second transistor T2 may be separately controlled, thereby increasing the flexibility of controlling the pixel circuit. The embodiment of the present disclosure will be described by taking an example in which the gate of the fourth transistor T4 and the gate of the second transistor T2 are electrically connected to the first scan signal line Gate 1.

With continued reference to FIG. 2, the first light emitting control signal and the second light emitting control signal may be the same. That is, the gate of the fifth transistor T5 and the gate of the sixth transistor T6 may be electrically connected to a same signal line, e.g., the first light emitting control signal line EM1, to receive a same signal (e.g., the first light emitting control signal), such that the display substrate may not be provided with the second light emitting control signal line EM2, thereby reducing the number of signal lines. Alternatively, the gate of the fifth transistor T5 and the gate of the sixth transistor T6 may be electrically connected to different signal lines, respectively. That is, the gate of the fifth transistor T5 is electrically connected to the first light emitting control signal line EM1, the gate of the sixth transistor T6 is electrically connected to the second light emitting control signal line EM2, and signals transmitted by the first light emitting control signal line EM1 and the second light emitting control signal line EM2 are the same.

It should be noted that when the fifth transistor T5 and the sixth transistor T6 are different types of transistors, for example, when the fifth transistor T5 is a P-type transistor and the sixth transistor T6 is an N-type transistor, the first light emitting control signal and the second light emitting control signal may also be different, which is not limited in the embodiment of the present disclosure. The embodiment of the present disclosure will be described by taking an example in which the gate of the fifth transistor T5 and the gate of the sixth transistor T6 are connected to the first light emitting control line.

For example, the first reset control signal and the second reset control signal may be the same. That is, the gate of the first transistor T1 and the gate of the seventh transistor T7 may be electrically connected to a same signal line, e.g., the first reset control signal line Reset1, to receive a same signal (e.g., the first reset control signal), such that the display substrate may not be provided with the second reset control signal line Rst2, thereby reducing the number of signal lines. Alternatively, the gate of the first transistor T1 and the gate of the seventh transistor T7 may be electrically connected to different signal lines, respectively. That is, the gate of the first transistor T1 is electrically connected to a first reset control signal line Reset1, the gate of the seventh transistor T7 is electrically connected to a second reset control signal line Reset2, and signals transmitted by the first reset control signal line Reset1 and the second reset control signal line Reset2 are the same. It should be noted that the first reset control signal and the second reset control signal may be different from each other.

For example, in some examples, the second reset control signal may be the same as the scan signal, i.e., the gate of the seventh transistor T7 may be electrically connected to the scan signal line Gate to receive the scan signal as the second reset control signal.

For example, the source of the first transistor T1 and the drain of the seventh transistor T7 are connected to the first initialization signal line Vinit1 and the second initialization signal line Vinit2, respectively, and the first initialization signal line Vinit1 and the second initialization signal line Vinit2 may be direct current (DC) reference voltage terminals to output a constant DC reference voltage. The first initialization signal line Vinit1 and the second initialization signal line Vinit2 may be the same, for example, the source of the first transistor T1 and the source of the seventh transistor T7 are connected to a same initialization signal line. The first initialization signal line Vinit1 and the second initialization signal line Vinit2 may be a high voltage terminal or a low voltage terminal, as long as they may provide the first initialization signal and the second initialization signal to reset the gate of the driving transistor T3 and the first electrode of the light emitting element, which is not limited by the present disclosure. For example, the source of the first transistor T1 and the source of the seventh transistor T7 may both be connected to an initialization signal line Init.

It should be noted that the driving sub-circuit 3, the data write sub-circuit 4, the storage sub-circuit 8, the threshold compensation sub-circuit 2, and the first reset sub-circuit 1 and the second reset sub-circuit 7 in the pixel circuit shown in FIG. 2 are only exemplary, and specific structures of sub-circuits such as the driving sub-circuit, the data write sub-circuit, the storage sub-circuit, the threshold compensation sub-circuit, and the reset sub-circuit may be set according to practical application requirements, which is not specifically limited in the embodiment of the present disclosure.

In the prior art, in order to improve a switching performance of the first transistor and a second switching transistor in the pixel driving circuit, the two transistors are usually dual-gate transistors, which certainly will adversely affect the improvement of the resolution of the display panel. For the above problems, the embodiment of the present disclosure provides the following technical solution.

Figure 3:
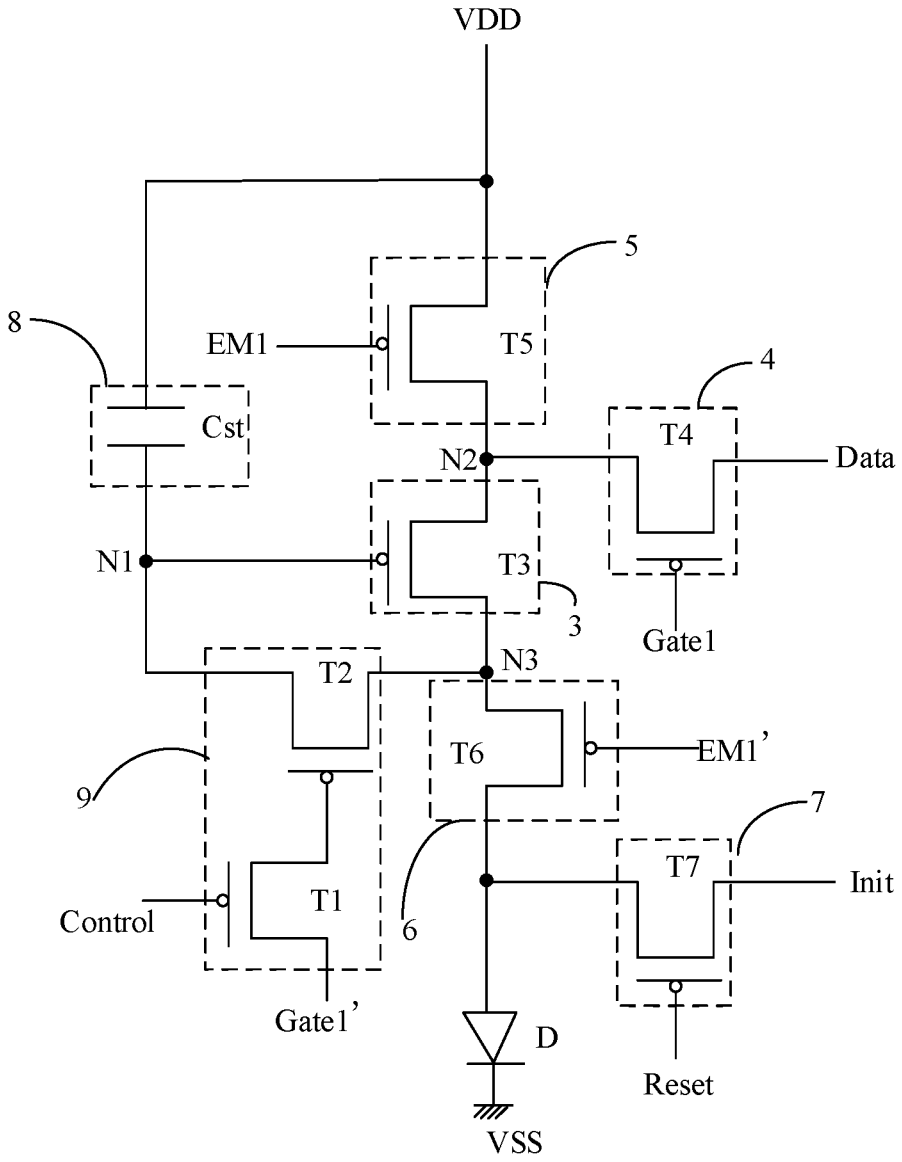
FIG. 3 is a schematic diagram of a pixel driving circuit according to an embodiment of the present disclosure.

In a first aspect, FIG. 2 is a schematic diagram of a pixel driving circuit according to an embodiment of the present disclosure. FIG. 3 is a schematic diagram of another pixel driving circuit according to an embodiment of the present disclosure. As shown in FIGS. 2 and 3, an embodiment of the present disclosure provides a pixel driving circuit, including: a data write sub-circuit 4, a driving sub-circuit 3, a reset sub-circuit 7, a first light emitting control sub-circuit 5, a second light emitting control sub-circuit 6, an auxiliary function sub-circuit 9, and a storage sub-circuit 8. The driving sub-circuit 3 includes a driving transistor T3 configured to generate a driving current according to voltages at its first and control electrodes to drive the light emitting device D to be driven. In a data write and threshold compensation stage, the data write sub-circuit 4 is configured to write a data voltage to the first electrode of the driving sub-circuit 3 in response to the first scan signal; the auxiliary function sub-circuit 9 is configured to compensate a threshold voltage of the driving transistor T3; the storage sub-circuit 8 is configured to store the data voltage. In an initialization stage, the auxiliary function sub-circuit 9 is configured to make a current flow through the gate and the source of the driving transistor T3; the reset sub-circuit 7 is configured to initialize the first electrode of the light emitting device D to be driven by the initialization signal in response to the reset control signal, and the second light emitting control sub-circuit 6 transmits the initialization signal to the second electrode of the driving sub-circuit 3 in response to the second light emitting control signal. In a light emitting stage, the first light emitting control sub-circuit 5 is configured to write a first power voltage to the first electrode of the driving transistor T3 in response to the first light emitting control signal, such that the driving transistor T3 generates the driving current; the second light emitting control sub-circuit 6 is configured to transmit the driving current to the light emitting device D to be driven in response to the second light emitting control signal.

In the embodiment of the present disclosure, the auxiliary function sub-circuit 9 may not only compensate the threshold voltage of the driving transistor T3 in the data write stage, but also reset the gate of the driving transistor T3 in cooperation with the second light emitting sub-circuit and the reset sub-circuit 7 in the initialization stage. That is, the auxiliary function sub-circuit 9 in the embodiment of the present disclosure has both a threshold compensation function and a reset function, so that the simplification of the pixel driving circuit is achieved, which is helpful for the display panel of the embodiment of the present disclosure to achieve the high resolution.

In some embodiments, the auxiliary function sub-circuit 9 includes the first transistor T1 and the second transistor T2; the source of the first transistor T1 is connected to the drain of the second transistor T2, the drain of the first transistor T1 is connected to the gate of the driving transistor T3, and the gate of the first transistor T1 is connected to the first control signal line Control; the source of the second transistor T2 is connected to the drain of the driving transistor T3, and the gate of the second transistor T2 is connected to the second scan line Gate1'. The first control signal line Control is written with a low level signal at least in the initialization stage and the data write and threshold compensation stage.

For example: in the initialization stage, the reset sub-circuit 7 initializes the first electrode of the light emitting device D to be driven by the initialization signal under the control of the reset control signal, so that a potential of the first electrode of the light emitting device D is an initialization potential, and at the same time, the second control signal line EM1', the second scan line Gate1' and the first control signal line Control are all written with a low level signal, the first transistor T1 and the second transistor T2 are turned on. A potential of the gate of the driving transistor T3 is reset to the initialization potential by the first transistor T1, the second transistor T2 and the second light emitting control sub-circuit 6.

In the data write and threshold compensation stage, the second scan line Gate1' and the first control signal line Control are both written with low level signals, the first transistor T1 and the second transistor T2 are turned on, the gate and the drain of the driving transistor T3 are connected such that the driving transistor T3 is used as a diode. The threshold voltage of the driving transistor T3 is compensated by the data voltage written on the data line Data.

In some embodiments, the auxiliary function sub-circuit 9 includes the first transistor T1 and the second transistor T2; the source of the first transistor T1 is connected to the drain of the second transistor T2, the drain of the first transistor T1 is connected to the gate of the driving transistor T3, and the gate of the first transistor T1 is connected to the first control signal line Control; the source of the second transistor T2 is connected to the drain of the driving transistor T3 and the gate of the second transistor T2 is connected to the second scan line Gate1', such that the first control signal line Control is configured to write any one of the operating level signal, a signal opposite to the first light emitting control signal, and the second scan signal in a scan period of one frame image. If the first control signal line Control is always written with the operating level signal, the first transistor T1 is in a turn-on state in a scan period of one frame, for which a timing sequence is simple and a control is easy. If the signal written in the first control signal line Control is the signal opposite to the first light emitting control signal, the first switching transistor is not turned on in the light emitting stage, but is turned on only in the data write and threshold compensation stage and the initialization stage, so that the risk of leakage current generated by the first transistor T1 may be effectively reduced, and the service life of the first transistor T1 may be prolonged. If the first control signal line Control is written with the second scan signal, the gate of the first transistor T1 and the gate of the second transistor T2 may be connected together at this time to provide the second scan signal to the first transistor T1 and the second transistor T2 through one signal line, which facilitates wiring on the display panel.

In some embodiments, the auxiliary function sub-circuit 9 includes: the first transistor T1 and the second transistor T2; the source of the first transistor T1 is connected to the second scan line Gate1', the drain of the first transistor T1 is connected to the gate of the second transistor T2, and the gate of the first transistor T1 is connected to the first control signal line Control; the source of the second transistor T2 is connected to the drain of the driving transistor T3, and the drain of the second transistor T2 is connected to the gate of the driving transistor T3.

For example: in the initialization stage, the reset sub-circuit 7 initializes the first electrode of the light emitting device D to be driven by the initialization signal under the control of the reset control signal, so that a potential of the first electrode of the light emitting device D is an initialization potential, and at the same time, the second control signal line EM1', the second scan line Gate1' and the first control signal line Control are all written with a low level signal, the first transistor T1 and the second transistor T2 are turned on. A potential of the gate of the driving transistor T3 is reset to the initialization potential by the first transistor T1, the second transistor T2 and the second light emitting control sub-circuit 6.

In the data write and threshold compensation stage, the second scan line Gate1' and the first control signal line Control are both written with low level signals, the first transistor T1 and the second transistor T2 are turned on, the gate and the drain of the driving transistor T3 are connected such that the driving transistor T3 is used as a diode. The threshold voltage of the driving transistor T3 is compensated by the data voltage written on the data line Data.

In some embodiments, the auxiliary function sub-circuit 9 includes: the first transistor T1 and the second transistor T2; the source of the first transistor T1 is connected to the second scan line Gate1', the drain of the first transistor T1 is connected to the gate of the second transistor T2, and the gate of the first transistor T1 is connected to the first control signal line Control; the source of the second transistor T2 is connected to the drain of the driving transistor T3 and the drain of the second transistor T2 is connected to the gate of the driving transistor T3, such that the first control signal line Control is configured to write any one of a signal opposite to the first light emitting control signal or the second scan signal in a scan period of one frame image. If the signal written in the first control signal line Control is a signal opposite to the first light emitting control signal, the first switching transistor is not turned on in the light emitting stage, but is turned on only in the data write and threshold compensation stage and the initialization stage, so that the risk of leakage current generated by the first transistor T1 may be effectively reduced, and the service life of the first transistor T1 may be prolonged. If the first control signal line Control is written with the second scan signal, the gate and the source of the first transistor T1 may be connected together at this time to provide the second scan signal to the gate and the source of the first transistor T1 through one signal line, which facilitates wiring on the display panel.

In some embodiments, the data write sub-circuit 4 includes the fourth transistor T4; the source of the fourth transistor T4 is connected to the data line Data, the drain of the fourth transistor T4 is connected to the source of the driving transistor T3, and the gate of the fourth transistor T4 is connected to the first scan line Gate1.

For example: in the data write and threshold compensation stage, the first scan line Gate1 may be written with a low level signal, the fourth transistor T4 is turned on, and the data voltage signal written on the data line Data is written to the source of the driving transistor until the gate-source voltage Vgs of the driving transistor T3 is the threshold voltage.

In some embodiments, the first light emitting control sub-circuit 5 includes the fifth transistor T5, the source of the fifth transistor T5 is connected to the first power voltage line Vdd, the drain of the fifth transistor T5 is connected to the source of the driving transistor T3, and the gate of the fifth transistor T5 is connected to the first control signal line EM1.

For example: in the light emitting stage, the first control signal line EM1 is written with a low level signal, the fifth transistor T5 is turned on, the first voltage on the first power voltage line Vdd is transmitted to the source of the driving transistor T3, so that the driving transistor T3 outputs the driving current to the second light emitting control sub-circuit 6. In the light emitting stage, the second light emitting control sub-circuit 6 operates simultaneously, to output the driving current to the first electrode of the light emitting device D, causing the light emitting device D to emit light.

In some embodiments, the second light emitting control sub-circuit 6 includes the sixth transistor T6; the source of the sixth transistor T6 is connected to the drain of the driving transistor T3, the drain of the sixth transistor T6 is connected to the first electrode of the light emitting device D, and the gate of the sixth transistor T6 is connected to the second control signal line EM1'.

For example: in the light emitting stage, the second control signal line EM1' written with a low level signal, the sixth transistor T6 is turned on, such that the driving current output from the driving transistor T3 is output to the first electrode of the light emitting device D, causing the light emitting device D to emit light.

In some embodiments, the reset sub-circuit 7 includes the seventh transistor T7; the source of the seventh transistor T7 is connected to the first electrode of the light emitting device D, the drain of the seventh transistor T7 is connected to the initialization signal line Init, and the gate of the seventh transistor T7 is connected to the second scan line Gate1'.

For example: in the initialization stage, the seventh transistor T7 is turned on, and the auxiliary function sub-circuit 9 and the second light emitting control sub-circuit 6 also operate, and the initialization signal line Init writes the initialization signal to reset the first electrode of the light emitting device D and simultaneously reset the gate of the driving transistor T3.

In some embodiments, the storage sub-circuit 8 includes the storage capacitor Cst, the first electrode plate of the storage capacitor Cst is connected to the gate of the driving transistor T3 and the second electrode plate of the storage capacitor Cst is connected to the first power voltage line Vdd.

For example: in the data write and threshold compensation stage, the data write sub-circuit 4 writes the data voltage signal into the source of the driving transistor T3, and the storage capacitor Cst stores the data voltage signal.

In order to clarify the specific structure of the pixel driving circuit according to the embodiment of the present disclosure, the pixel driving circuit according to the embodiment of the present disclosure is described below with reference to specific examples.

In one example, referring to FIG. 2, the pixel driving circuit includes: the data write sub-circuit 4, the driving sub-circuit 3, the first light emitting control sub-circuit 5, the second light emitting control sub-circuit 6, the auxiliary function sub-circuit 9, the reset sub-circuit 7, and the storage sub-circuit 8. The data write sub-circuit 4 includes the fourth transistor T4; the driving sub-circuit 3 includes the driving transistor T3; the first light emitting control sub-circuit 5 includes the fifth transistor T5; the second light emitting control sub-circuit 6 includes the sixth transistor T6; the reset sub-circuit 7 includes the seventh transistor T7; the auxiliary function sub-circuit 9 includes the first transistor T1 and the second transistor T2; the storage sub-circuit 8 includes the storage capacitor Cst.

With continued reference to FIG. 2, the source of the first transistor T1 is connected to the drain of the second transistor T2, the drain of the first transistor T1 is connected to the gate of the driving transistor T3, and the gate of the first transistor T1 is connected to the first control signal line Control. The first control signal line Control is configured to be input with a low level signal in a display period of one frame. The source of the second transistor T2 is connected to the drain of the driving transistor T3, and the gate of the second transistor T2 is connected to the second scan line Gate1'. The source of the fourth transistor T4 is connected to the data line Data, the drain of the fourth transistor T4 is connected to the source of the driving transistor T3, and the gate of the fourth transistor T4 is connected to the first scan line Gate1. The source of the fifth transistor T5 is connected to the first power voltage line Vdd, the drain of the fifth transistor T5 is connected to the source of the driving transistor T3, and the gate of the fifth transistor T5 is connected to the first control signal line EM1. The source of the sixth transistor T6 is connected to the drain of the driving transistor T3, the drain of the sixth transistor T6 is connected to the first electrode of the light emitting device D, and the gate of the sixth transistor T6 is connected to the second control signal line EM1'. The source of the seventh transistor T7 is connected to the first electrode of the light emitting device D, the drain of the seventh transistor T7 is connected to the initialization signal line Init, and the gate of the seventh transistor T7 is connected to the reset signal line Reset. The first electrode plate of the storage capacitor Cst is connected to the gate of the driving transistor T3, and the second electrode plate of the storage capacitor Cst is connected to the first power voltage line Vdd.

Figure 4:
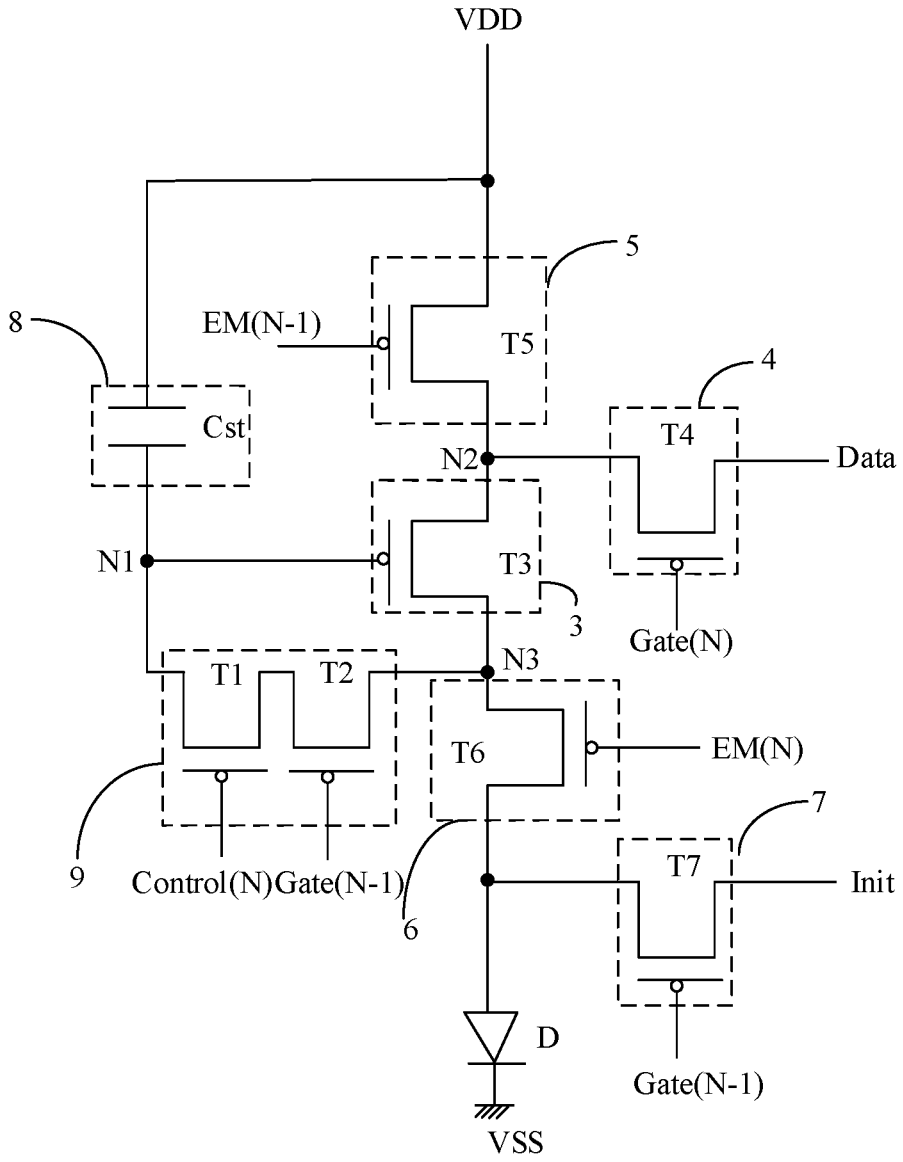
FIG. 4 is a schematic diagram of a pixel driving circuit according to an embodiment of the present disclosure.

It should be noted that FIG. 4 is a schematic diagram of another pixel driving circuit according to an embodiment of the present disclosure. As shown in FIG. 4, when the pixel driving circuits are applied to the display panel, and the pixel driving circuits in the display panel are arranged in an array, for the pixel driving circuits in a same row, gates of the fourth transistors T4 are connected to a same first scan line Gate1, gates of the first transistors T1 are connected to a same first control signal line, gates of the second transistors T2 are connected to a same second scan line Gate1', gates of the fifth transistors T5 are connected to a same first light emitting control line EM1, gates of the sixth transistors T6 are connected to a same second light emitting control line EM1', and gates of the seventh transistors T7 are connected to a same reset signal line Reset. For the pixel driving circuits in a same column, sources of the fourth transistors T4 are connected to a same data line Data, and sources of the fifth transistor T5 and second electrode plates of the storage capacitors Cst are connected to a same first power signal line VDD. In order to simplify the wiring of the display panel and optimize the driving timing of the display panel, the first scan line Gate (N+1) connected to the (N+1)th row of pixel driving circuits may be multiplexed (also used) as the second scan line Gate(N)' and the reset signal line Reset(N) connected to the (N+1)th row of pixel driving circuits; the first light emitting control line EM(N+1) connected to the (N+1)th row of the pixel driving circuits is multiplexed as the second light emitting control line EM(N) connected to the Nth row of the pixel driving circuits; N is an integer greater than or equal to 1.

The driving method for the pixel driving circuit will be described below by taking a driving process for one pixel driving circuit located in the Nth row as an example. The description will be given by taking an example in which the gate of the second transistor T2 and the gate of the seventh transistor T7 in the pixel driving circuit are both connected to the first scan line Gate(N−1) to which the (N−1)th row of the pixel driving circuits are connected; the gate of the sixth transistor T6 in the pixel driving circuit is connected to the first light emitting control line EM(N−1) to which the (N−1)th row of the pixel units are connected.

Figure 5:
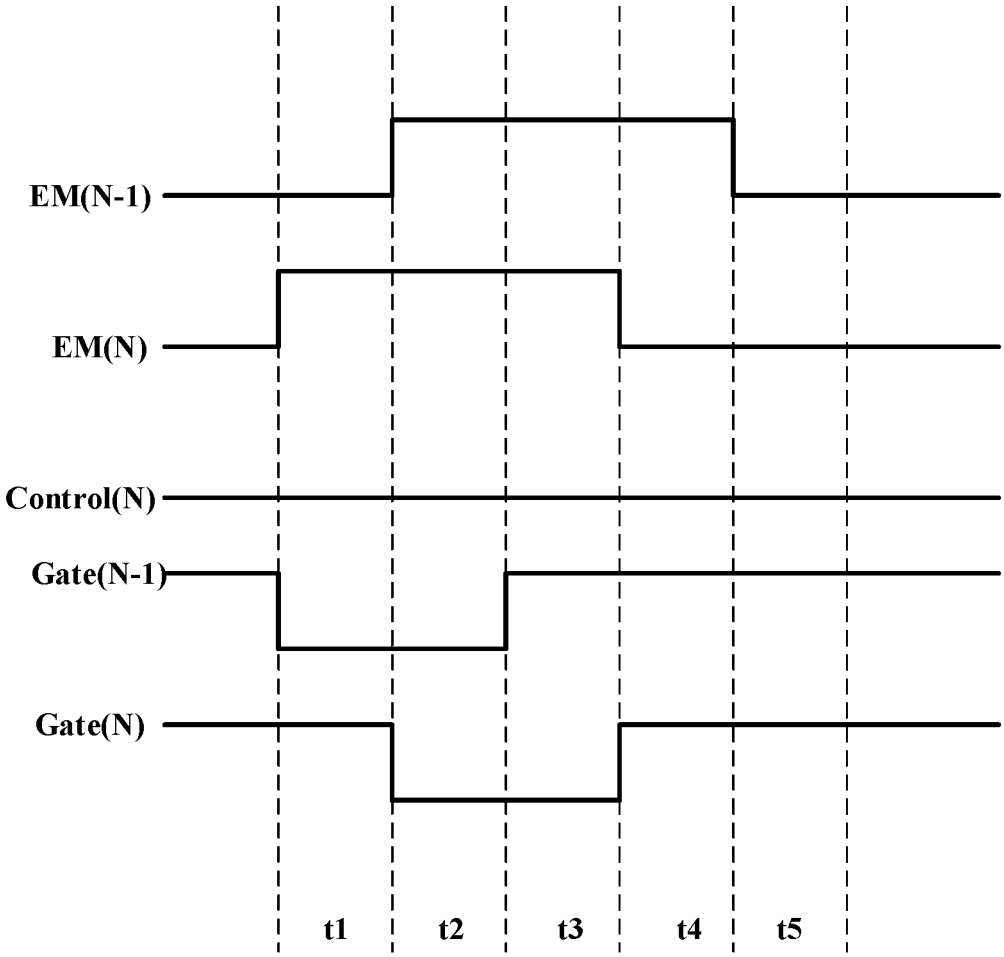
FIG. 5 is a timing diagram illustrating signals in an operation of the pixel driving circuit shown in FIG. 4.
Figure 6:
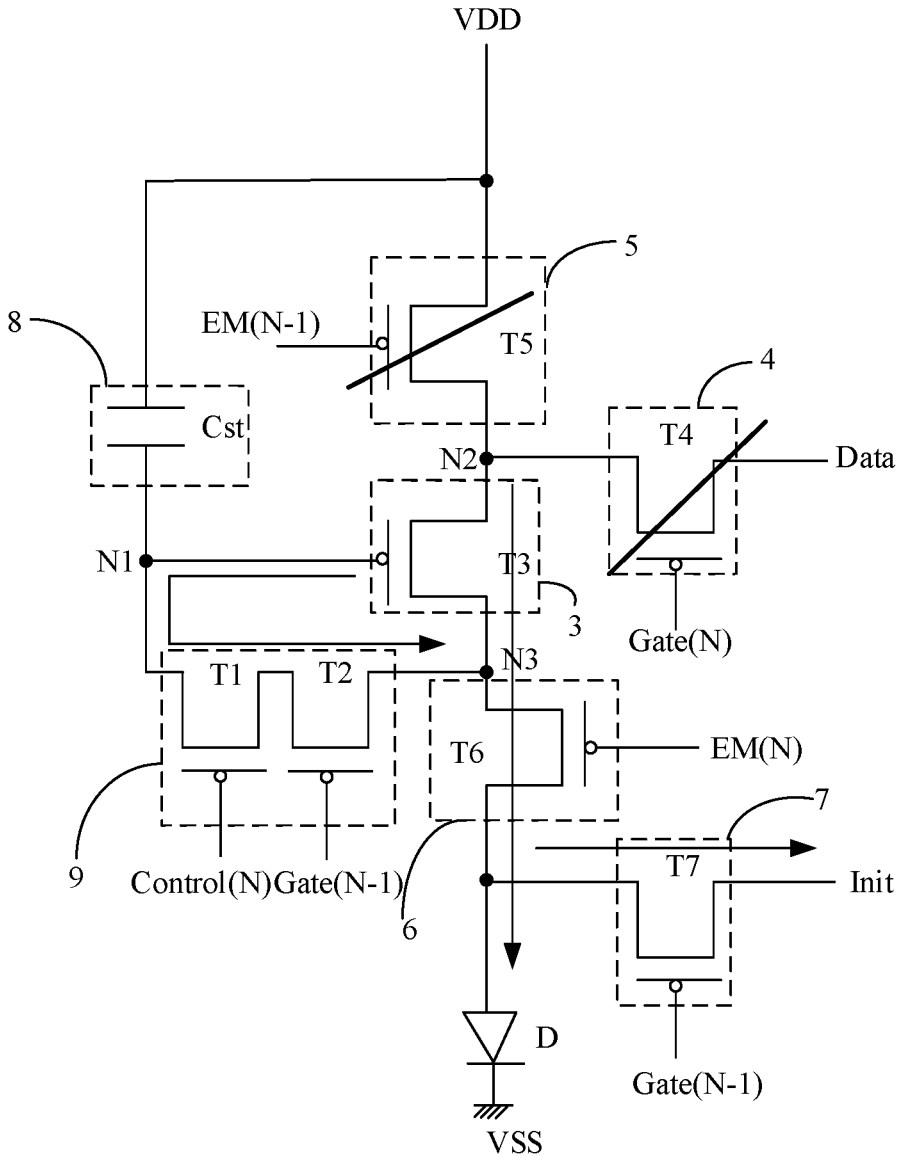
FIG. 6 is a schematic diagram illustrating transistors in a turn-on state in an initialization stage in the pixel driving circuit shown in FIG. 4.

FIG. 5 is a timing diagram illustrating signals in an operation of the pixel driving circuit shown in FIG. 4; referring to FIGS. 4 and 5, the driving method for the pixel driving circuit includes the following stages:

An initialization stage (t1): FIG. 6 is a schematic diagram illustrating transistors in a turn-on state in an initialization stage in the pixel driving circuit shown in FIG. 4. As shown in FIG. 6, a low level signal is input to the first scan line Gate(N−1) and the first light emitting control line EM(N−1) in the (N−1)th row, a low level signal is input to the first control signal line Control(N). At this time, the first transistor T1, the second transistor T2, the sixth transistor T6 and the seventh transistor T7 are turned on, a high level signal is written to the initialization signal line Init, and at this time, the first electrode (N4 node) of the light emitting device D, the drain (N3 node) of the driving transistor T3 and the gate (N1 node) of the driving transistor T3 all have respective high level signals, so that the gate of the driving transistor T3 and the first electrode of the light emitting device D are reset.

Figure 7:
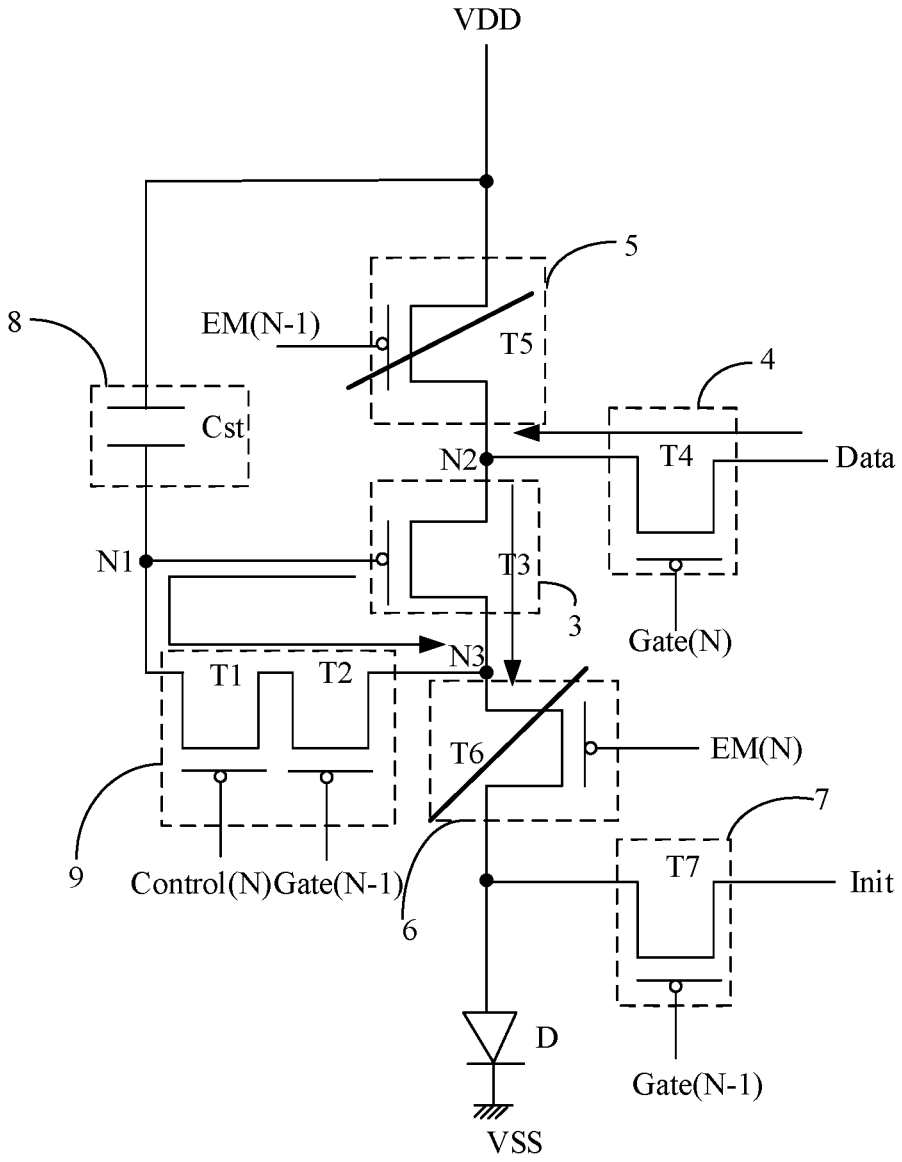
FIG. 7 is a schematic diagram illustrating transistors in a turn-on state in a data write and threshold compensation stage in the pixel driving circuit shown in FIG. 4.

A data write and threshold compensation stage (t2): FIG. 7 is a schematic diagram illustrating transistors in a turn-on state in a data write and threshold compensation stage in the pixel driving circuit shown in FIG. 4. As shown in FIG. 7, the low level signal is continuously input to the first scan line Gate(N−1) in the (N−1)th row, and the low level signal is also written to the first scan line Gate(N) of the Nth row, a high level signal is written to the first light emitting control line EM(N−1) of the (N−1)th row and the first light emitting control line EM(N) in the Nth row, the low level signal is continuously input to the first control signal line Control(N). At this time, the first transistor T1, the second transistor T2, the driving transistor T3 and the fourth transistor T4 are all turned on, the driving transistor T3 is connected by the first transistor T1 and the second transistor T2 to be formed as a diode, the data voltage written to the data line Data is written to the gate of the driving transistor T3 through the fourth transistor T4, the first transistor T1 and the second transistor T2, until the driving transistor T3 is turned off. The voltage at the gate (N1 node) of the driving transistor T3 is Vdata+Vth (Vth<0, Vth is the threshold voltage of the driving transistor T3), and is stored in the storage capacitor Cst. The voltages at the first and second electrode plates of the storage capacitor Cst are Vdata+Vth and Vdd, respectively.

Figure 8:
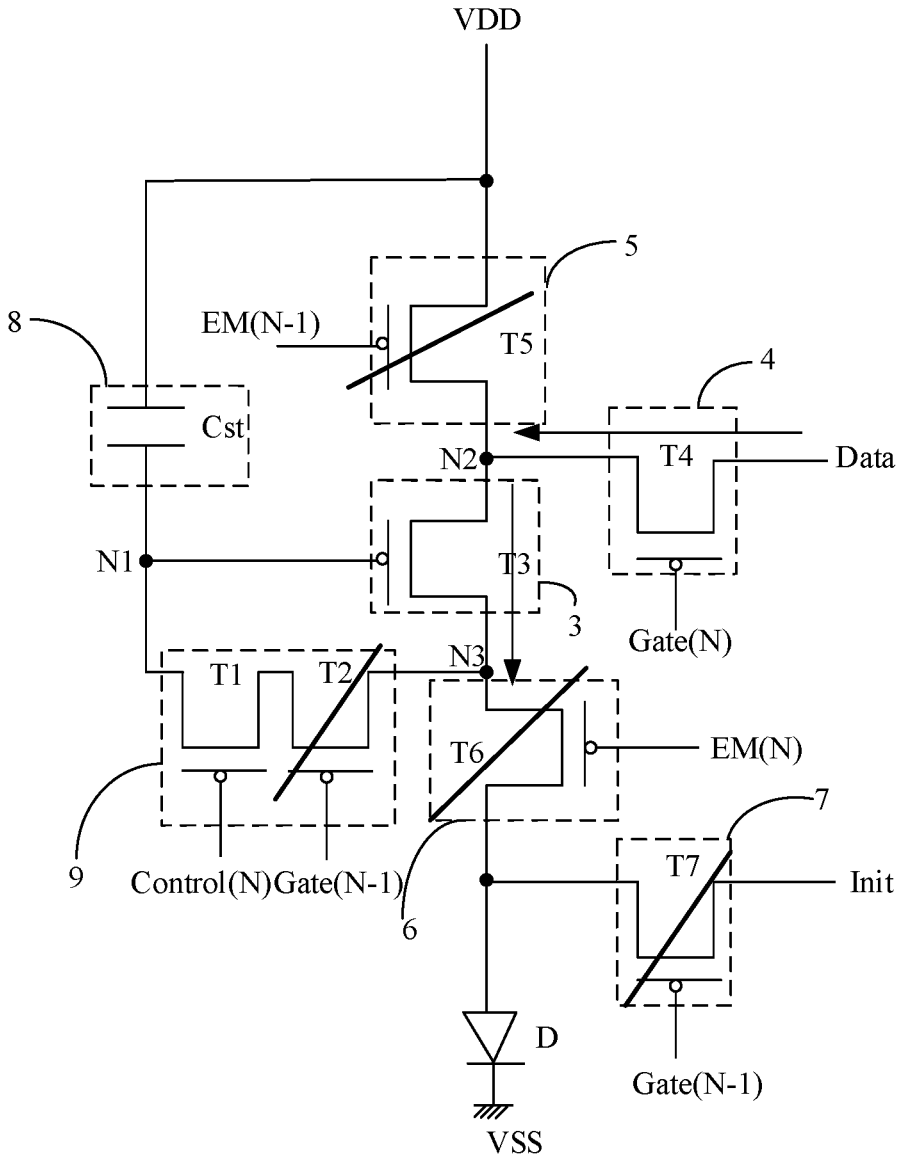
FIG. 8 is a schematic diagram illustrating transistors in a turn-on state in a data continuous write stage in the pixel driving circuit shown in FIG. 4.

A data continuous write stage (t3): FIG. 8 is a schematic diagram illustrating transistors in a turn-on state in a data continuous write stage in the pixel driving circuit shown in FIG. 4. As shown in FIG. 8, a high level signal is input to the first scan line Gate(N−1) in the (N−1)th row, the low level signal is continuously written to the first scan line Gate(N) in the Nth row, a high level signal is written to both the first light emitting control line EM(N−1) in the (N−1)th row and the first light emitting control line EM(N) in the Nth row, the low level signal is continuously input to the first control signal line Control(N). At this time, only the fourth transistor T4, the first transistor T1 and the driving transistor T3 are turned on, and the data voltage written on the data line Data continuously charges the source (node N2) of the driving transistor T3, so that the driving transistor T3 is fully turned on.

Figure 9:
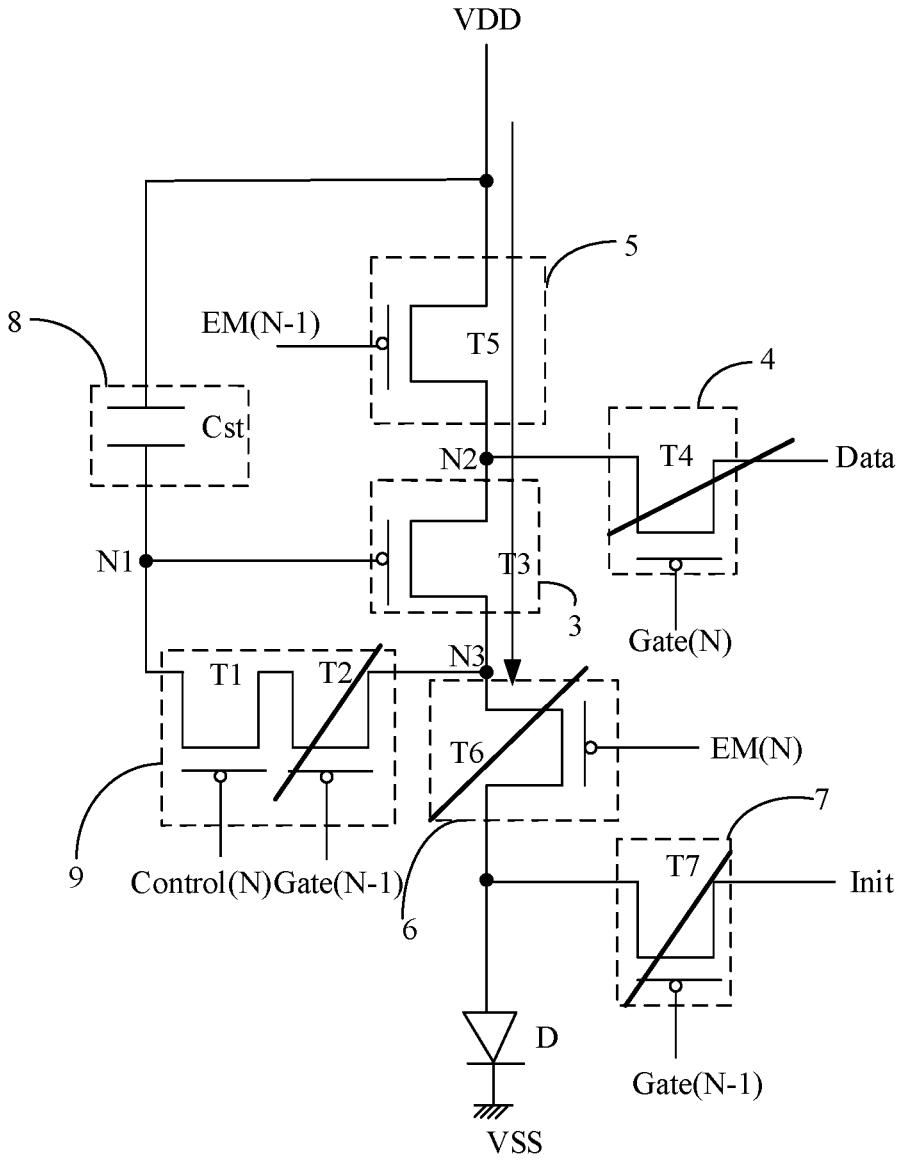
FIG. 9 is a schematic diagram illustrating transistors in a turn-on state in a pre-light emitting stage in the pixel driving circuit shown in FIG. 4.

A pre-light emitting stage (t4): FIG. 9 is a schematic diagram illustrating transistors in a turn-on state in a pre-light emitting stage in the pixel driving circuit shown in FIG. 4. As shown in FIG. 9, a high level signal is input to both the first scan line Gate(N−1) in the (N−1)th row and the first scan line Gate(N) in the Nth row, a low level signal is written to the first light emitting control line EM(N−1) in the (N−1)th row, the high level signal is still written to the first light emitting control line EM(N) in the Nth row, and the low level signal is continuously input to the first control signal line Control(N). At this time, only the first transistor T1, the fifth transistor T5, and the driving transistor T3 are turned on, the first voltage on the first power voltage line Vdd is written to the source (N3 node) of the driving transistor T3, and at this time, the potential at the N3 node is changed from Vdate to Vdd.

Figure 10:
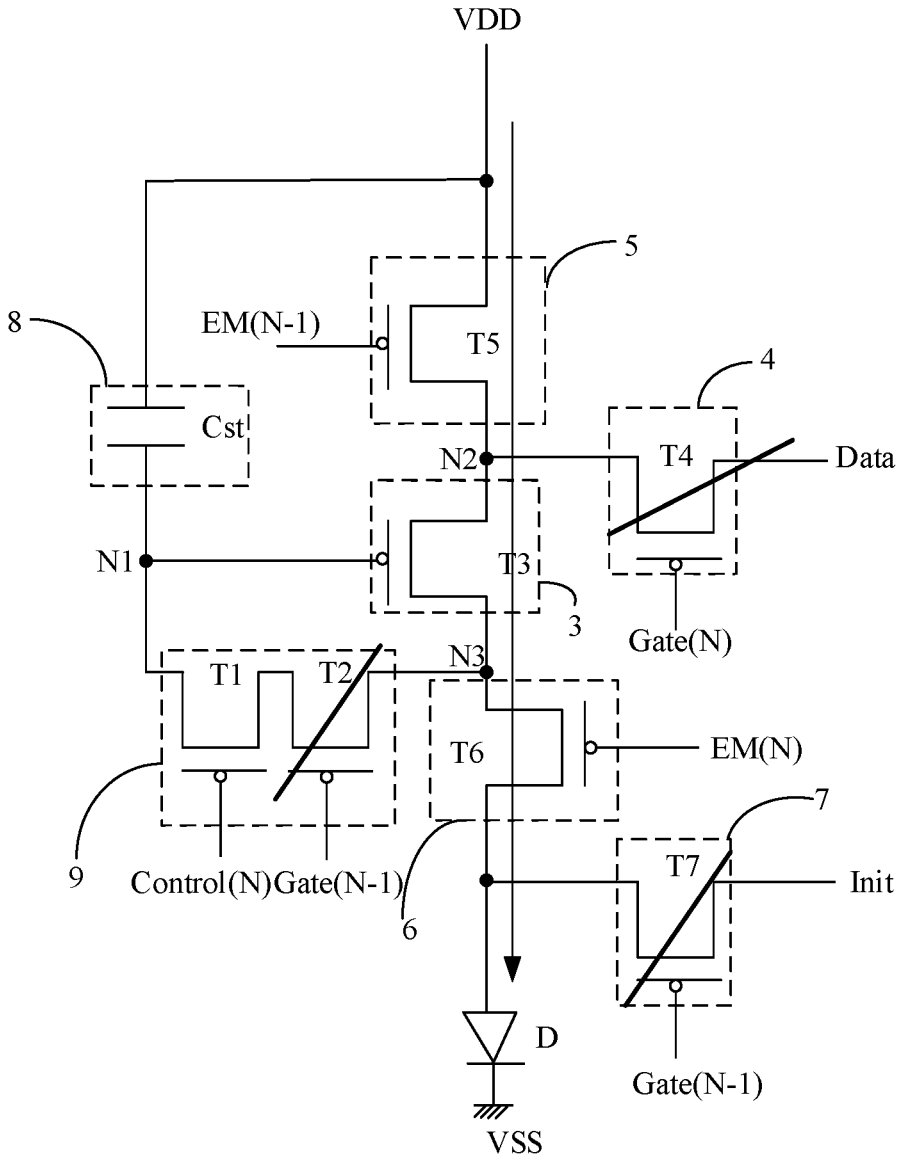
FIG. 10 is a schematic diagram illustrating transistors in a turn-on state in a light emitting stage in the pixel driving circuit shown in FIG. 4.

A light emitting stage (t5): FIG. 10 is a schematic diagram illustrating transistors in a turn-on state in a light emitting stage in the pixel driving circuit shown in FIG. 4. As shown in FIG. 10, a high level signal is input to both the first scan line Gate(N−1) in the (N−1)th row and the first scan line Gate (N) in the Nth row, a low level signal is written to both the first light emitting control line EM(N−1) in the (N−1)th row and the first light emitting control line EM(N) in the Nth row, and the low level signal is continuously input to the first control signal line Control(N). At this time, the fifth transistor T5, the driving transistor T3, and the sixth transistor T6 are all turned on, so as to drive the light emitting device D to emit light.

Additionally, at this stage, the voltage at the gate of the driving transistor T3 is Vdata+Vth, and the voltage at the source of the driving transistor T3 is Vdd, so that the gate-source voltage of the driving transistor T3 is: Vgs=(Vdata+Vth)−Vdd, until an initialization stage of a next frame.

A light emitting current of the light emitting device D is equal to a current flowing through the driving transistor T3, which is expressed as follows:

$$ID=\beta(Vgs-Vth)^2=\beta(Vdata+Vth-dd-Vth)^2=\beta(Vdata-Vdd)^2 \quad (1)$$

where, $$\beta=\frac{1}{2}\mu_n C_{ox}\left(\frac{W}{L}\right),$$

$\mu_n$ is the electron mobility of the driving transistor T3; $C_{ox}$ is an insulation capacitance per unit area, and W/L is a width-to-length ratio of the driving transistor T3.

As shown in the above formula (1), the current of the light emitting device D is independent of the threshold voltage of the driving transistor T3 in the light emitting stage, so as to avoid the influence of the threshold voltage of the driving transistor T3 on the display uniformity of the display panel.

Figure 11:
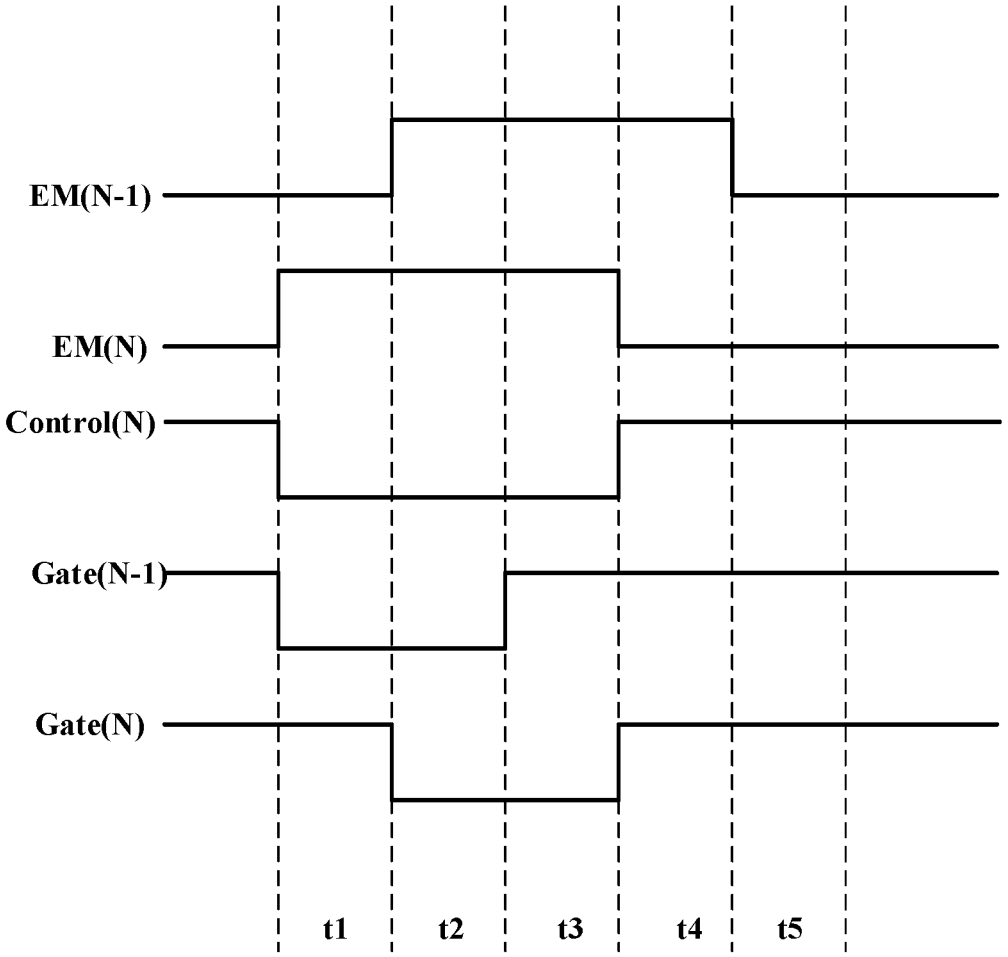
FIG. 11 is a timing diagram illustrating signals in an operation of the pixel driving circuit shown in FIG. 4.

In another example, the pixel driving circuit has the same structure as that of the pixel driving circuit shown in FIG. 4 except that a signal input to the first control signal line in a display period of one frame image is a signal opposite to a signal of the first light emitting control line. Similarly, driving a pixel driving circuit located in the Nth row is taken as an example. FIG. 11 is another timing diagram illustrating an operation of the pixel driving circuit shown in FIG. 4. As shown in FIG. 11, the first light emitting control line Control(N) is written with the low level signal only in the initialization stage, the data write and threshold compensation stage, and the data continuous write stage. That is, the first transistor T1 operates only in these three stages, and the first transistor T1 is in a turn-off state in other stages. For the pixel driving circuit of the embodiment of the present disclosure, the auxiliary functional sub-circuit 9 only needs to operate in the initialization stage and the data write and threshold compensation stage, to reset the gate of the driving transistor T3 and compensate the threshold of the driving transistor T3. In this way, it is helpful to prolong the service life of the first transistor T1 and also may prevent the first transistor T1 from being turned on for a long time to generate leakage current, compared with the case in which the low level signal is continuously input to the first control signal line. The driving method for the pixel driving circuit is the same as the above-mentioned method, and therefore, the description thereof is not repeated.

Figure 12:
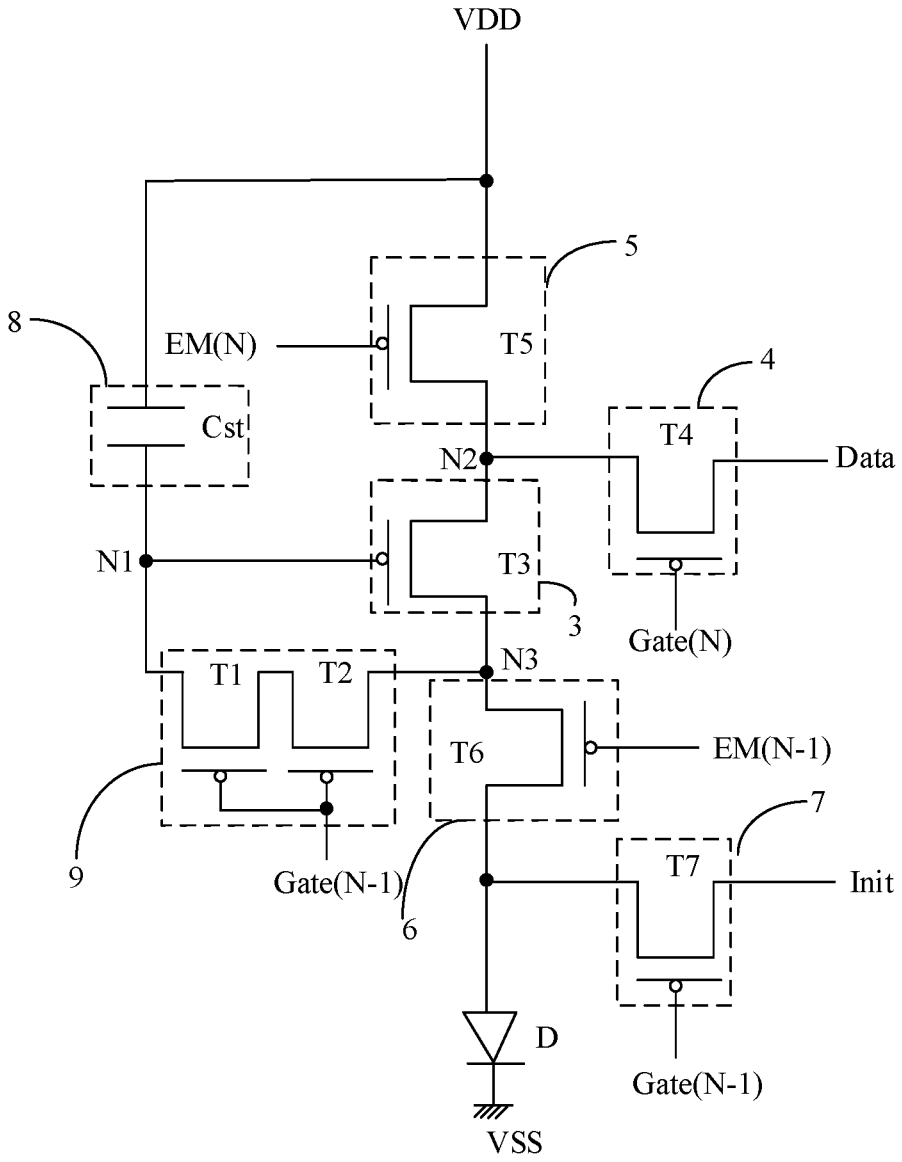
FIG. 12 is a schematic diagram of a pixel driving circuit according to an embodiment of the present disclosure.
Figure 13:
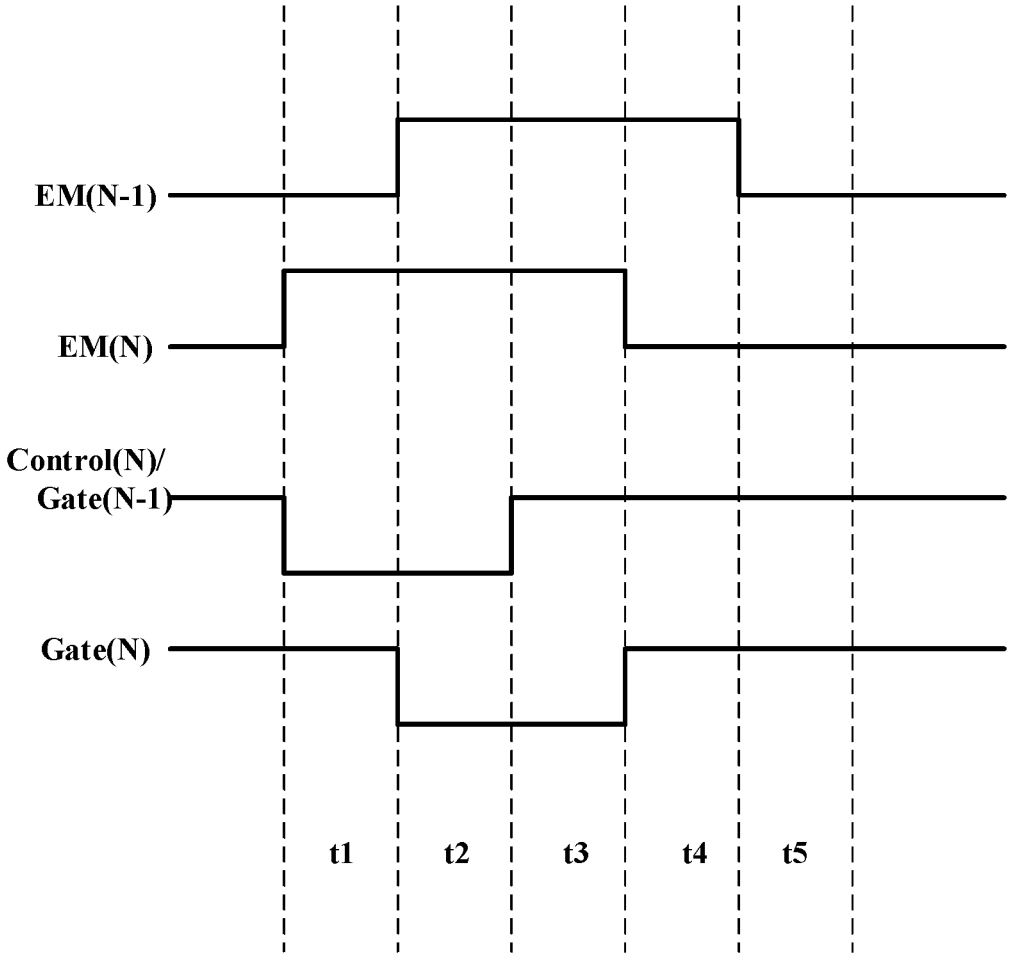
FIG. 13 is timing diagram illustrating signals in an operation of the pixel driving circuit shown in FIG. 12.

In another example, FIG. 12 is a schematic diagram of another pixel driving circuit according to an embodiment of the present disclosure. As shown in FIG. 12, the pixel driving circuit has the same configuration as the pixel driving circuit shown in FIG. 4, except that a signal input to the first light emitting control line Control(N) in the display period of one frame image is the second scan signal Gate(N). That is, the second scan signal line may be multiplexed as the first light emitting control line. Similarly, driving a pixel driving circuit located in the Nth row is taken as an example. FIG. 13 is timing diagram illustrating an operation of the pixel driving circuit shown in FIG. 12. As shown in FIG. 13, the first control signal line is written with a low signal only in the initialization stage, the data write and threshold compensation stage. That is, the first transistor T1 operates only in these two stages, and the first transistor T1 is in a turn-off state in other stages. For the pixel driving circuit of the embodiment of the present disclosure, the auxiliary functional sub-circuit 9 only needs to operate in the initialization stage and the data write and threshold compensation stage, to reset the gate of the driving transistor T3 and compensate the threshold of the driving transistor T3. In this way, it is helpful to prolong the service life of the first transistor T1 and also may prevent the first transistor T1 from being turned on for a long time to generate leakage current, compared with the case in which the low level signal is continuously input to the first control signal line. In addition, the first control signal line Control (N) and the second scan line Gate (N) are multiplexed, and the wiring of the display panel to which the pixel driving circuit is applied may also be optimized. The driving method for the pixel driving circuit is the same as the above-mentioned method, and therefore, the description thereof is not repeated.

Figure 14:
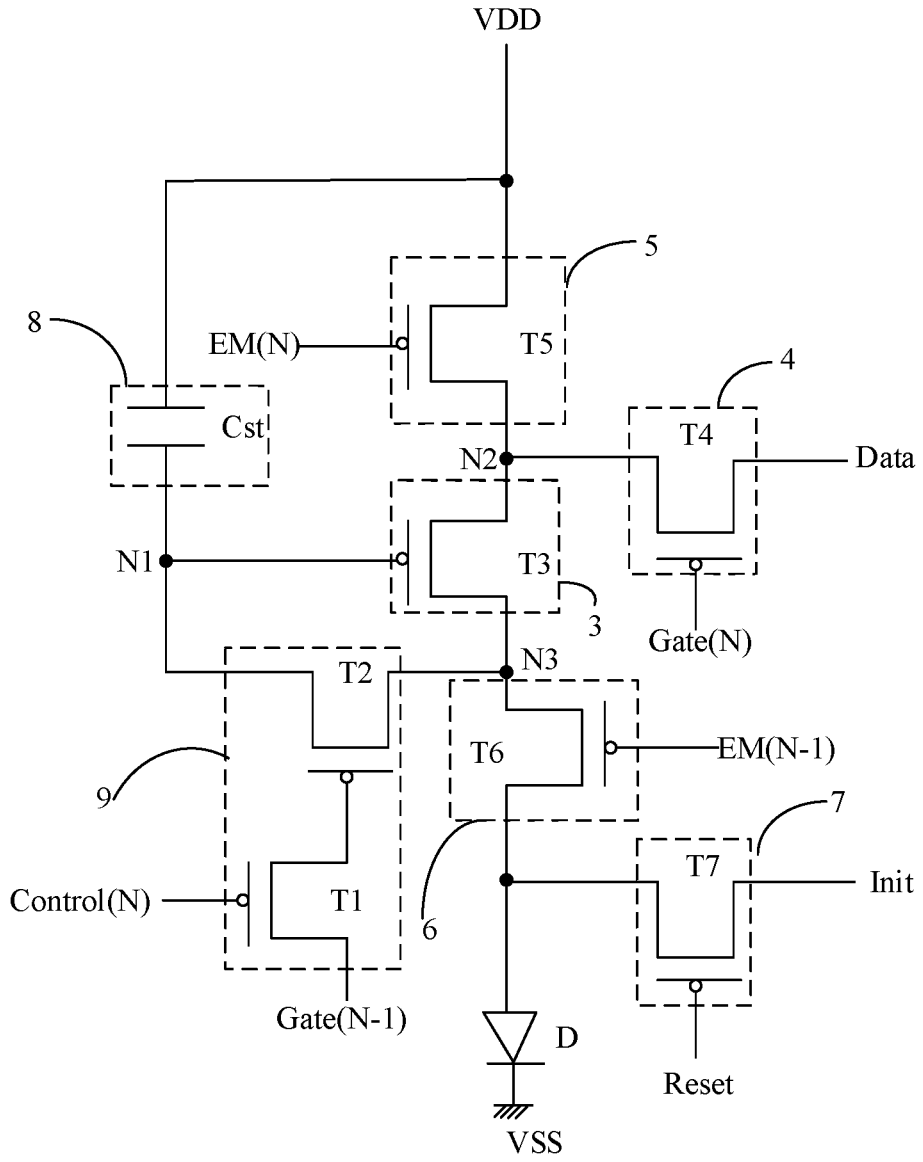
FIG. 14 is a schematic diagram of a pixel driving circuit according to an embodiment of the present disclosure.

In another example, FIG. 14 is a schematic diagram of another pixel driving circuit according to an embodiment of the present disclosure. As shown in FIG. 14, the structure of the pixel driving circuit is substantially similar to that of the pixel driving circuit of FIG. 4 described above, except the structure of the auxiliary function sub-circuit 9. Although the auxiliary function sub-circuit 9 includes the first transistor T1 and the second transistor T2 as in the pixel driving circuit shown in FIG. 4, a connection relationship between the first transistor T1 and the second transistor T2 is changed. Referring to FIG. 14, in the pixel driving circuit, the source of the first transistor T1 of the auxiliary function sub-circuit 9 is connected to the second scan line, the drain of the first transistor T1 is connected to the gate of the second transistor T2, and the gate of the first transistor T1 is connected to the first light emitting control line; the source of the second transistor T2 is connected to the gate of the driving transistor T3, and the drain of the second transistor T2 is connected to the drain of the driving transistor T3. The signal input to the first control signal line in a scan period of one frame image is a signal opposite to the first light emitting control signal.

It should be noted that when the pixel driving circuits are applied to the display panel, and the pixel driving circuits in the display panel are arranged in an array, for the pixel driving circuits in a same row, gates of the fourth transistors T4 are connected to a same first scan line, gates of the first transistors T1 are connected to a same first control signal line Control, sources of the first transistors T1 are connected to a same second scan line Gate1', gates of the fifth transistors T5 are connected to a same first light emitting control line EM1, gates of the sixth transistors T6 are connected to a same second light emitting control line EM1', and gates of the seventh transistors T7 are connected to a same reset signal line Reset. For the pixel driving circuits in a same column, sources of the fourth transistors T4 are connected to a same data line Data, and sources of the fifth transistor T5 and second electrode plates of the storage capacitors Cst are connected to a same first power signal line VDD. In order to simplify the wiring of the display panel and optimize the driving timing of the display panel, the first scan line Gate(N+1) connected to the (N+1)th row of pixel driving circuits may be multiplexed (also used) as the second scan line Gate(N)' and the reset signal line Reset(N) connected to the (N+1)th row of pixel driving circuits; the first light emitting control line EM(N+1) connected to the (N+1)th row of the pixel driving circuits is multiplexed as the second light emitting control line EM(N) connected to the Nth row of the pixel driving circuits; N is an integer greater than or equal to 1.

The driving method for the pixel driving circuit will be described below by taking a driving process for one pixel driving circuit located in the Nth row as an example. The description will be given by taking an example in which the gate of the second transistor T2 and the gate of the seventh transistor T7 in the pixel driving circuit are both connected to the first scan line Gate(N−1) to which the (N−1)th row of the pixel driving circuits are connected; the gate of the sixth transistor T6 in the pixel driving circuit is connected to the first light emitting control line EM(N−1) to which the (N−1)th row of the pixel units are connected.

Figure 15:
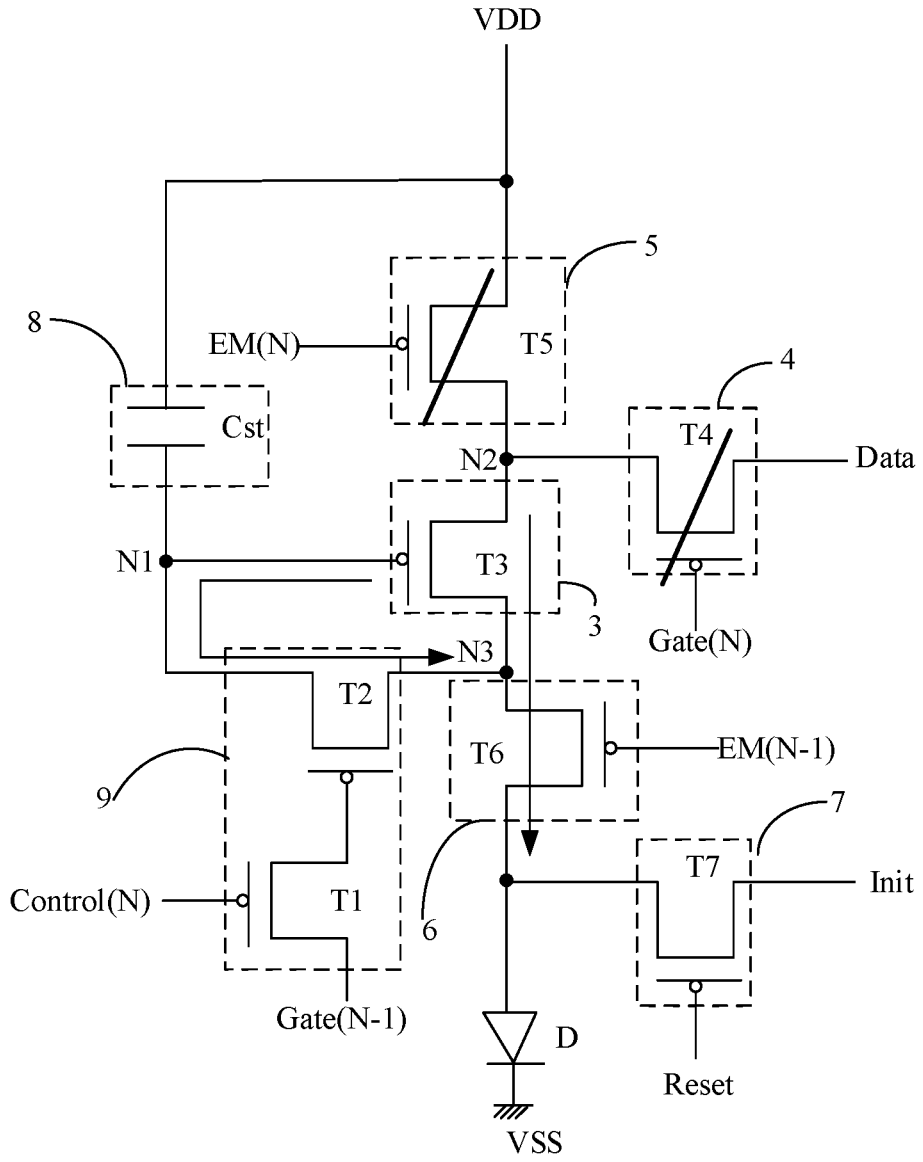
FIG. 15 is a schematic diagram illustrating transistors in a turn-on state in an initialization stage in the pixel driving circuit shown in FIG. 14.

The timing shown in FIG. 11 may be used as a timing diagram of an operation of the pixel driving circuit shown in FIG. 14. Referring to FIGS. 14 and 11, the driving method for the pixel driving circuit includes the following stages:

Initialization stage (t1): FIG. 15 is a schematic diagram illustrating transistors in a turn-on state in an initialization stage in the pixel driving circuit shown in FIG. 14. As shown in FIG. 15, a low level signal is input to the first scan line Gate(N−1) and the first light emitting control line EM(N−1) in the (N−1)th row, a low level signal is input to the first control signal line Control(N). At this time, the first transistor T1, the sixth transistor T6 and the seventh transistor T7 are turned on, since the source of the first transistor T1 is connected to the first scan line Gate(N−1) of the (N−1)th row, the second transistor T2 is also turned on. At the same time, a high level signal is written to the initialization signal line Init, and at this time, the first electrode (N4 node) of the light emitting device D, the drain (N3 node) of the driving transistor T3 and the gate (N1 node) of the driving transistor T3 all have respective high level signals, so that the gate of the driving transistor T3 and the first electrode of the light emitting device D are reset.

Figure 16:
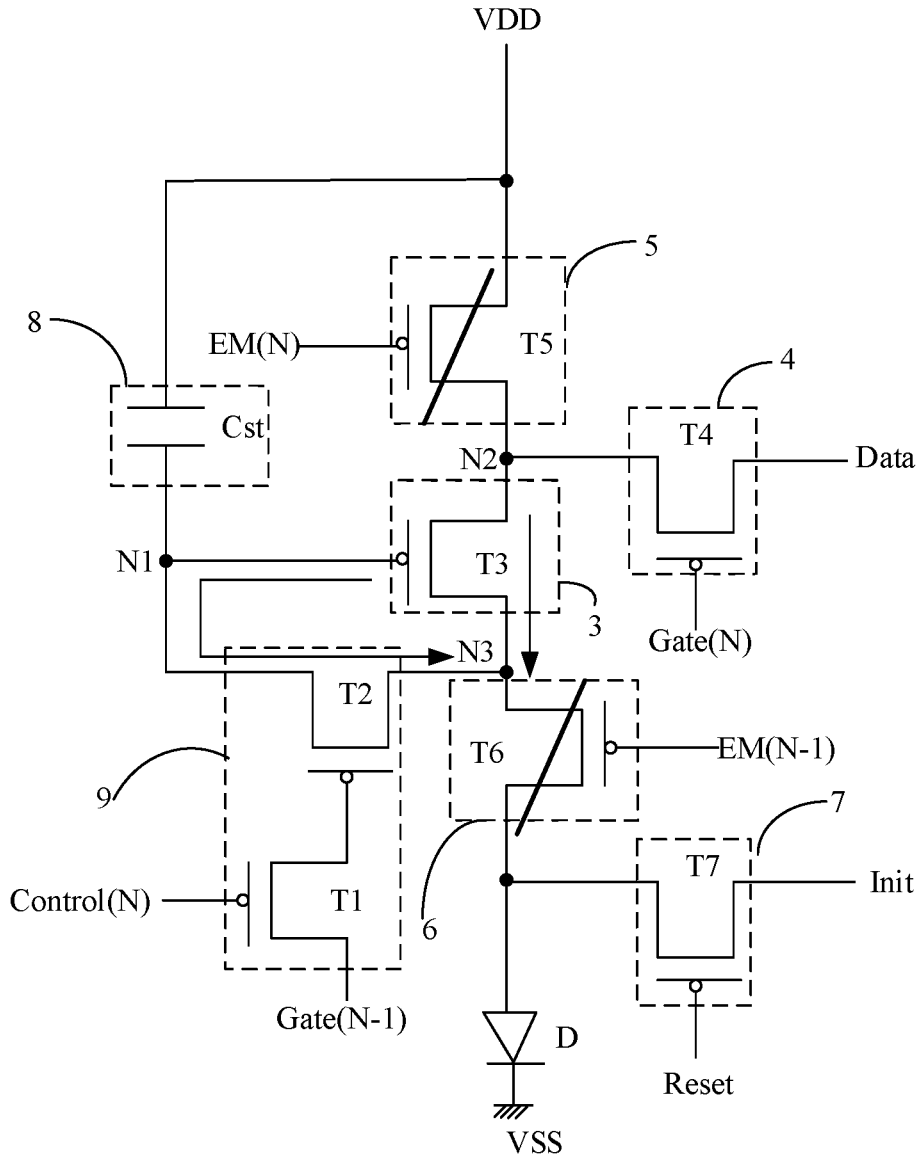
FIG. 16 is a schematic diagram illustrating transistors in a turn-on state in a data write and threshold compensation stage in the pixel driving circuit shown in FIG. 14.

Data write and threshold compensation stage (t2): FIG. 16 is a schematic diagram illustrating transistors in a turn-on state in a data write and threshold compensation stage in the pixel driving circuit shown in FIG. 14. As shown in FIG. 16, the low level signal is continuously input to the first scan line Gate(N−1) in the (N−1)th row, and the low level signal is also written to the first scan line Gate(N) of the Nth row, a high level signal is written to the first light emitting control line EM(N−1) of the (N−1)th row and the first light emitting control line EM(N) in the Nth row, the low level signal is continuously input to the first control signal line Control(N). At this time, the first transistor T1, the second transistor T2, the driving transistor T3 and the fourth transistor T4 are all turned on, the driving transistor T3 is connected by the first transistor T1 and the second transistor T2 to be formed as a diode, the data voltage written to the data line Data is written to the gate of the driving transistor T3 through the fourth transistor T4, the first transistor T1 and the second transistor T2, until the driving transistor T3 is turned off. The voltage at the gate (N1 node) of the driving transistor T3 is Vdata+Vth (Vth<0, Vth is the threshold voltage of the driving transistor T3), and is stored in the storage capacitor Cst. The voltages at the first and second electrode plates of the storage capacitor Cst are Vdata+Vth and Vdd, respectively.

Figure 17:
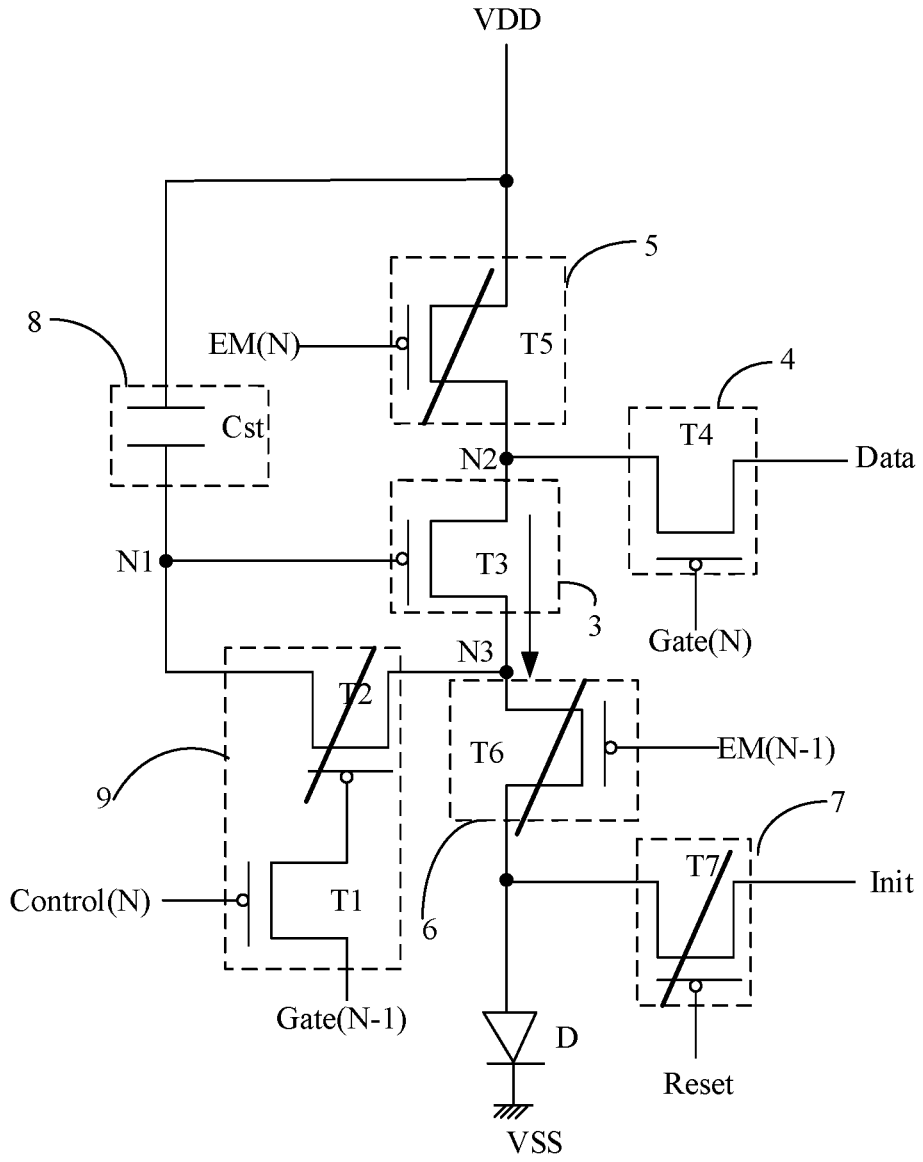
FIG. 17 is a schematic diagram illustrating transistors in a turn-on state in a data continuous write stage in the pixel driving circuit shown in FIG. 14.

Data continuous write stage (t3): FIG. 17 is a schematic diagram illustrating transistors in a turn-on state in a data continuous write stage in the pixel driving circuit shown in FIG. 14. As shown in FIG. 17, a high level signal is input to the first scan line Gate(N−1) in the (N−1)th row, the low level signal is continuously written to the first scan line Gate(N) in the Nth row, a high level signal is written to both the first light emitting control line EM(N−1) in the (N−1)th row and the first light emitting control line EM(N) in the Nth row, the low level signal is continuously input to the first control signal line Control(N). At this time, only the fourth transistor T4, the first transistor T1 and the driving transistor T3 are turned on, and the data voltage written on the data line Data continuously charges the source (node N2) of the driving transistor T3, so that the driving transistor T3 is fully turned on.

Figure 18:
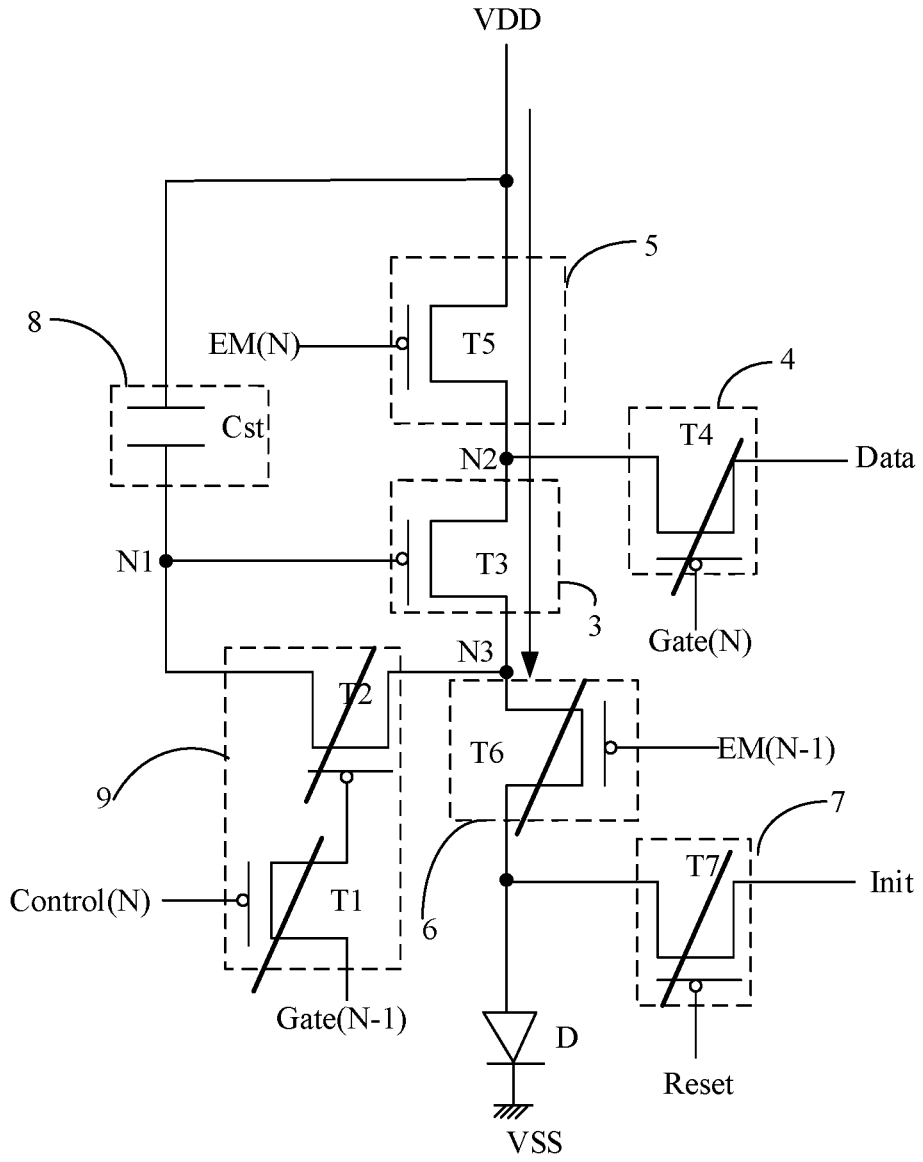
FIG. 18 is a schematic diagram illustrating transistors in a turn-on state in a pre-light emitting stage in the pixel driving circuit shown in FIG. 14.

Pre-light emitting stage (t4): FIG. 18 is a schematic diagram illustrating transistors in a turn-on state in a pre-light emitting stage in the pixel driving circuit shown in FIG. 14. As shown in FIG. 18, a high level signal is input to both the first scan line Gate(N−1) in the (N−1)th row and the first scan line Gate(N) in the Nth row, a low level signal is written to the first light emitting control line EM(N−1) in the (N−1)th row, the high level signal is still written to the first light emitting control line EM(N) in the Nth row, and the low level signal is continuously input to the first control signal line Control(N). At this time, only the first transistor T1, the fifth transistor T5, and the driving transistor T3 are turned on, the first voltage on the first power voltage line VDD is written to the source (N3 node) of the driving transistor T3, and at this time, the potential at the N3 node is changed from Vdate to Vdd.

Figure 19:
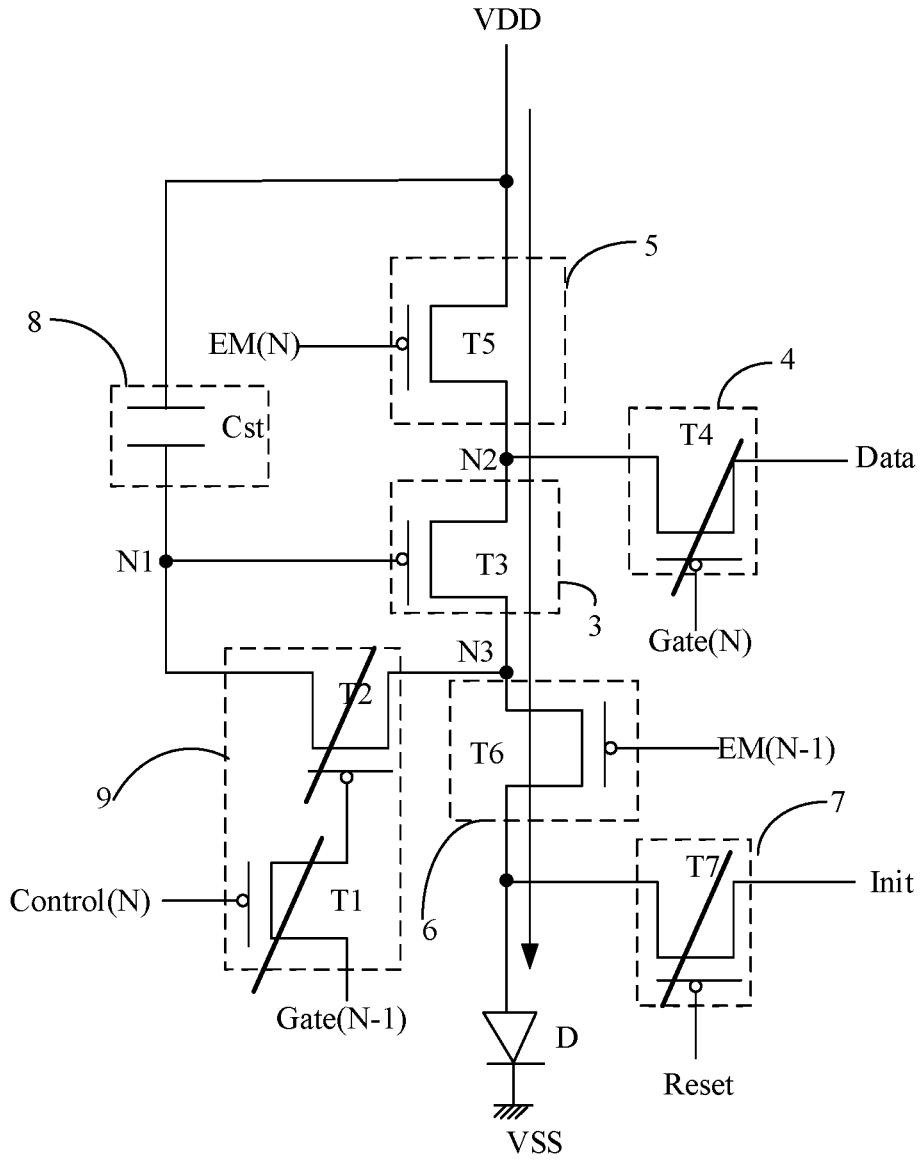
FIG. 19 is a schematic diagram illustrating transistors in a turn-on state in a light emitting stage in the pixel driving circuit shown in FIG. 14.

Light emitting stage (t5): FIG. 19 is a schematic diagram illustrating transistors in a turn-on state in a light emitting stage in the pixel driving circuit shown in FIG. 14. As shown in FIG. 19, a high level signal is input to both the first scan line Gate(N−1) in the (N−1)th row and the first scan line Gate (N) in the Nth row, a low level signal is written to both the first light emitting control line EM(N−1) in the (N−1)th row and the first light emitting control line EM(N) in the Nth row, and the low level signal is continuously input to the first control signal line Control(N). At this time, the fifth transistor T5, the driving transistor T3, and the sixth transistor T6 are all turned on, so as to drive the light emitting device D to emit light.

Additionally, at this stage, the voltage at the gate of the driving transistor T3 is Vdata+Vth, and the voltage at the source of the driving transistor T3 is Vdd, so that the gate-source voltage of the driving transistor T3 is: Vgs=(Vdata+Vth)−Vdd, until an initialization stage of a next frame.

A light emitting current of the light emitting device D is equal to a current flowing through the driving transistor T3, which is expressed as follows:

$$ID=\beta(Vgs-Vth)^2=\beta(Vdata+Vth-dd-Vth)^2=\beta(Vdata-Vdd)^2 \quad (1)$$

where, $$\beta=\frac{1}{2}\mu_n C_{ox}\left(\frac{W}{L}\right),$$

$\mu_n$ is the electron mobility of the driving transistor T3; $C_{ox}$ is an insulation capacitance per unit area, and W/L is a width-to-length ratio of the driving transistor T3.

As shown in the above formula (1), the current of the light emitting device D is independent of the threshold voltage of the driving transistor T3 in the light emitting stage, so as to avoid the influence of the threshold voltage of the driving transistor T3 on the display uniformity of the display panel.

Figure 20:
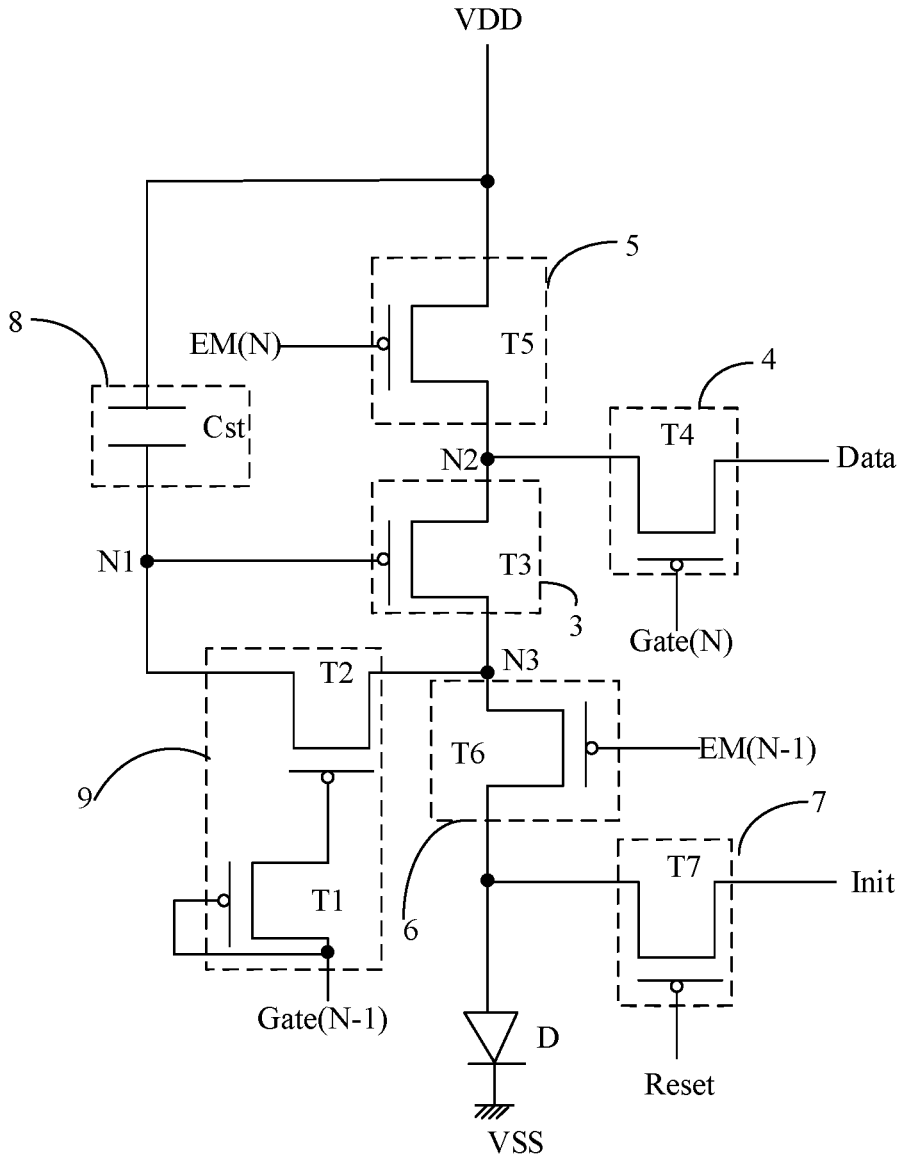
FIG. 20 is a schematic diagram of a pixel driving circuit according to an embodiment of the present disclosure.

In another example, FIG. 20 is a schematic diagram of another pixel driving circuit according to an embodiment of the present disclosure. As shown in FIG. 20, the pixel driving circuit has substantially the same structure as the driving circuit of the pixel shown in FIG. 14, except that the signal written on the first control signal line in the pixel driving circuit is the second scan signal. That is, the second scan signal line may be multiplexed with the first control signal line, and at this time, the gate and the source of the first transistor T1 may be connected together. Other functional blocks in the pixel driving circuit may be the same as those of the above pixel driving circuit, which is not described in detail here. Similarly, driving a pixel driving circuit located in the Nth row is taken as an example. The timing diagram of FIG. 13 may be used as the timing diagram of an operation of the pixel driving circuit shown in FIG. 20. As shown in FIG. 13, the first control signal line is written with a low signal only in the initialization stage, the data write and threshold compensation stage. That is, the first transistor T1 operates only in these two stages, and the first transistor T1 is in a turn-off state in other stages. For the pixel driving circuit of the embodiment of the present disclosure, the auxiliary functional sub-circuit 9 only needs to operate in the initialization stage and the data write and threshold compensation stage, so as to reset the gate of the driving transistor T3 and compensate the threshold of the driving transistor T3. In this way, it is helpful to prolong the service life of the first transistor T1 and also may prevent the first transistor T1 from being turned on for a long time to generate leakage current. In addition, the first control signal line and the second scan line are multiplexed, and the wiring of the display panel to which the pixel driving circuit is applied may also be optimized. The driving method for the pixel driving circuit is the same as the above-mentioned method, and therefore, the description thereof is not repeated.

In a second aspect, embodiments of the present disclosure provide a display panel, where the pixel driving circuit in the display panel may adopt any one of the pixel driving circuits described above.

In one example, the pixel driving circuits are arranged in an array; when the auxiliary function sub-circuit includes the first transistor T1 and the second transistor T2; the source of the first transistor T1 is connected to the drain of the second transistor T2, the drain of the first transistor T1 is connected to the gate of the driving transistor T3, and the gate of the first transistor T1 is connected to the first control signal line; the source of the second transistor T2 is connected to the drain of the driving transistor T3, and the gate of the second transistor T2 is connected to the second scan line.

For the pixel driving circuits located in a same row, respective data write sub-circuits 4 are connected to a same first scan line; respective first light emitting control sub-circuits 5 are connected to a same first light emitting control line; respective second light emitting control sub-circuits 6 are connected to a same second light emitting control line; in respective auxiliary function sub-circuits 9, control electrodes of the first transistors T1 are connected to a same first control signal line, and control electrodes of the second transistors T2 are connected to a same second scan line; respective reset sub-circuits 7 are connected to a same reset signal line Reset.

For the pixel driving circuits in a same column, respective data write sub-circuits 4 are connected to a same data line Data; respective first light emitting control sub-circuits 5 and respective storage sub-circuits 8 are connected to a same first power signal line; respective reset sub-circuits 7 are connected to a same initialization signal line Init.

The first scan line connected to the pixel driving circuits in the (N+1)th row is multiplexed as the second scan line and the reset signal line Reset connected to the pixel driving circuits in the Nth row; the first light emitting control line connected to the pixel driving circuits in the (N+1)th row is multiplexed as the second light emitting control line connected to the pixel driving circuits in the Nth row; N is an integer greater than or equal to 1.

In addition, for the above connection, the first control signal line may be written with a low level signal or a signal opposite to a signal of the second light emitting control line in a display period of one frame image.

In some embodiments, when the auxiliary function sub-circuit includes the first transistor T1 and the second transistor T2; the source of the first transistor T1 is connected to the drain of the second transistor T2, the drain of the first transistor T1 is connected to the gate of the driving transistor T3, and the gate of the first transistor T1 is connected to the first control signal line; the source of the second transistor T2 is connected to the drain of the driving transistor T3, and the gate of the second transistor T2 is connected to the second scan line. The first scan line connected to the pixel driving circuits in the (N+1)th row is also multiplexed as the first control signal line connected to the pixel driving circuits in the Nth row. That is, gates of the first transistors T1 in a same row may be connected to the gate of the second transistor T2, and thus, the wiring space of the display panel may be optimized.

In another example, the pixel driving circuits are arranged in an array; when the auxiliary function sub-circuit includes the first transistor T1 and the second transistor T2; the source of the first transistor T1 is connected to the second scan line, the drain of the first transistor T1 is connected to the gate of the second transistor T2, and the gate of the first transistor T1 is connected to the first control signal line; the source of the second transistor T2 is connected to the drain of the driving transistor T3, and the drain of the second transistor T2 is connected to the gate of the driving transistor T3.

For the pixel driving circuits located in a same row, respective data write sub-circuits 4 are connected to a same first scan line; respective first light emitting control sub-circuits 5 are connected to a same first light emitting control line, respective second light emitting control sub-circuits 6 are connected to a same second light emitting control line, and the gates of the first transistors T1 in respective auxiliary function sub-circuits 9 are connected to a same first control signal line; respective reset sub-circuits 7 are connected to a same reset signal line Reset; the sources of the first transistors T1 in respective auxiliary function sub-circuits 9 are connected to a same second scan line.

For the pixel driving circuits in a same column, respective data write sub-circuits 4 are connected to a same data line Data; respective first light emitting control sub-circuits 5 and respective storage sub-circuits 8 are connected to a same first power signal line; respective reset sub-circuits 7 are connected to a same initialization signal line Init.

When the auxiliary function sub-circuit includes the first transistor T1 and the second transistor T2; the source of the first transistor T1 is connected to the second scan line, the drain of the first transistor T1 is connected to the gate of the second transistor T2, and the gate of the first transistor T1 is connected to the first control signal line; the source of the second transistor T2 is connected to the drain of the driving transistor T3, and the source of the second transistor T2 is connected to the gate of the driving transistor T3. The first scan line connected to the pixel driving circuits in the (N+1)th row is multiplexed as the second scan line and the reset signal line Reset connected to the pixel driving circuits in the Nth row; the first light emitting control line connected to the pixel driving circuits in the (N+1)th row is multiplexed as the second light emitting control line connected to the pixel driving circuits in the Nth row; N is an integer greater than or equal to 1.

Since the display panel of the embodiment includes the pixel driving circuit, the display effect is better, and high-resolution display may be realized.

The display panel may be a liquid crystal display device or an electro-luminance display device, such as a liquid crystal panel, an OLED panel, a Micro LED panel, a Mini LED panel, a mobile phone, a tablet computer, a television, a display, a notebook computer, a digital photo frame, a navigator, and any other product or component with a display function.

It should be understood that the above embodiments are merely exemplary embodiments adopted to explain the principles of the present disclosure, and the present disclosure is not limited thereto. It will be apparent to one of ordinary skill in the art that various changes and modifications may be made therein without departing from the spirit and scope of the present disclosure, and such changes and modifications also fall within the scope of the present disclosure.

The invention claimed is:

1. A pixel driving circuit, comprising: a data write sub-circuit, a driving sub-circuit, a reset sub-circuit, a first light emitting control sub-circuit, a second light emitting control sub-circuit, an auxiliary function sub-circuit and a storage sub-circuit; wherein, the driving sub-circuit comprises a driving transistor configured to generate a driving current according to voltages at a first electrode and a control electrode of the driving transistor so as to drive a light emitting device to be driven;

in a data write and threshold compensation stage, the data write sub-circuit is configured to write a data voltage to a first electrode of the driving sub-circuit in response to a first scan signal; the auxiliary function sub-circuit is configured to compensate a threshold voltage of the driving transistor; the storage sub-circuit is configured to store the data voltage;

in an initialization stage, the auxiliary function sub-circuit is configured to make a control electrode and a second electrode of the driving transistor shorted; the reset sub-circuit is configured to initialize a first electrode of the light emitting device to be driven by an initialization signal in response to a reset control signal, and the second light emitting control sub-circuit transmits the initialization signal to a second electrode of the driving sub-circuit in response to a second light emitting control signal; and in a light emitting stage, the first light emitting control sub-circuit is configured to write a first power voltage to the first electrode of the driving transistor in response to a first light emitting control signal, such that the driving transistor generates the driving current; the second light emitting control sub-circuit is configured to transmit the driving current to the light emitting device to be driven in response to a second light emitting control signal;

wherein the auxiliary function sub-circuit comprises: a first transistor and a second transistor;

a first electrode of the first transistor is connected to a second electrode of the second transistor, a second electrode of the first transistor is connected to the control electrode of the driving transistor, and a control electrode of the first transistor is connected to a first control signal line;

a first electrode of the second transistor is connected to the second electrode of the driving transistor, and a control electrode of the second transistor is connected to a second scan line; and wherein in a scan period of one frame image, the first control signal line is configured to be written with any one of:

an operating level signal which is constant in the whole scan period of one frame image;

a reverse signal of the first light emitting control signal; and a second scan signal.

2. A display panel comprising a plurality of pixel driving circuits, each of which is the pixel driving circuit of claim 1.

3. The display panel of claim 2, wherein the pixel driving circuits are arranged in an array;

for the pixel driving circuits in a same row, respective data write sub-circuits are connected to a same first scan line; respective first light emitting control sub-circuits are connected to a same first light emitting control line; respective second light emitting control sub-circuits are connected to a same second light emitting control line; in respective auxiliary function sub-circuits, control electrodes of the first transistors are connected to a same first control signal line, and control electrodes of the second transistors are connected to a same second scan line; respective reset sub-circuits are connected to a same reset signal line;

for the pixel driving circuits in a same column, respective data write sub-circuits are connected to a same data line; respective first light emitting control sub-circuits and respective storage sub-circuits are connected to a same first power signal line; respective reset sub-circuits are connected to a same initialization signal line;

the first scan line connected to the pixel driving circuits in the (N+1)th row is multiplexed as the second scan line and the reset signal line connected to the pixel driving circuits in the Nth row; the first light emitting control line connected to the pixel driving circuits in the (N+1)th row is multiplexed as the second light emitting control line connected to the pixel driving circuits in the Nth row; N is an integer greater than or equal to 1.

4. The display panel of claim 3, wherein the first scan line to which the pixel driving circuits in the (N+1)th row are connected is further multiplexed as the first control signal line to which the pixel driving circuits in the Nth row are connected.

5. The pixel driving circuit of claim 1, wherein the data write sub-circuit comprises a fourth transistor; and a first electrode of the fourth transistor is connected to a data line, a second electrode of the fourth transistor is connected to the first electrode of the driving transistor, and a control electrode of the fourth transistor is connected to a first scan line;

wherein the first light emitting control sub-circuit comprises: a fifth transistor; and a first electrode of the fifth transistor is connected to a first power voltage line, a second electrode of the fifth transistor is connected to the first electrode of the driving transistor, and a control electrode of the fifth transistor is connected to a first light emitting control line;

wherein the second light emitting control sub-circuit comprises: a sixth transistor; and a first electrode of the sixth transistor is connected to the second electrode of the driving transistor, a second electrode of the sixth transistor is connected to the first electrode of the light emitting device to be driven, and a control electrode of the sixth transistor is connected to a second light emitting control line;

wherein the reset sub-circuit comprises: a seventh transistor; and a first electrode of the seventh transistor is connected to the first electrode of the light emitting device to be driven, a second electrode of the seventh transistor is connected to an initialization signal line, and a control electrode of the seventh transistor is connected to a reset signal line; and wherein the storage sub-circuit comprises: a storage capacitor; and a first electrode plate of the storage capacitor is connected to the control electrode of the driving transistor, and a second electrode plate of the storage capacitor is connected to a first power voltage line.

6. The pixel driving circuit of claim 1, wherein the data write sub-circuit comprises a fourth transistor; and a first electrode of the fourth transistor is connected to a data line, a second electrode of the fourth transistor is connected to the first electrode of the driving transistor, and a control electrode of the fourth transistor is connected to a first scan line.

7. The pixel driving circuit of claim 1, wherein the first light emitting control sub-circuit comprises: a fifth transistor; and a first electrode of the fifth transistor is connected to a first power voltage line, a second electrode of the fifth transistor is connected to the first electrode of the driving transistor, and a control electrode of the fifth transistor is connected to a first light emitting control line.

8. The pixel driving circuit of claim 1, wherein the second light emitting control sub-circuit comprises: a sixth transistor; and a first electrode of the sixth transistor is connected to the second electrode of the driving transistor, a second electrode of the sixth transistor is connected to the first electrode of the light emitting device to be driven, and a control electrode of the sixth transistor is connected to a second light emitting control line.

9. A pixel driving circuit, comprising: a data write sub-circuit, a driving sub-circuit, a reset sub-circuit, a first light emitting control sub-circuit, a second light emitting control sub-circuit, an auxiliary function sub-circuit and a storage sub-circuit; wherein, the driving sub-circuit comprises a driving transistor configured to generate a driving current according to voltages at a first electrode and a control electrode of the driving transistor so as to drive a light emitting device to be driven;

in a data write and threshold compensation stage, the data write sub-circuit is configured to write a data voltage to a first electrode of the driving sub-circuit in response to a first scan signal; the auxiliary function sub-circuit is configured to compensate a threshold voltage of the driving transistor; the storage sub-circuit is configured to store the data voltage;

in an initialization stage, the auxiliary function sub-circuit is configured to make a control electrode and a second electrode of the driving transistor shorted; the reset sub-circuit is configured to initialize a first electrode of the light emitting device to be driven by an initialization signal in response to a reset control signal, and the second light emitting control sub-circuit transmits the initialization signal to a second electrode of the driving sub-circuit in response to a second light emitting control signal; and in a light emitting stage, the first light emitting control sub-circuit is configured to write a first power voltage to the first electrode of the driving transistor in response to a first light emitting control signal, such that the driving transistor generates the driving current; the second light emitting control sub-circuit is configured to transmit the driving current to the light emitting device to be driven in response to a second light emitting control signal, wherein the auxiliary function sub-circuit comprises: a first transistor and a second transistor;

a first electrode of the first transistor is connected to a second scan line, a second electrode of the first transistor is connected to a control electrode of the second transistor, and a control electrode of the first transistor is connected to a first control signal line;

a first electrode of the second transistor is connected to the second electrode of the driving transistor, and a second electrode of the second transistor is connected to the control electrode of the driving transistor.

10. The pixel driving circuit of claim 9, wherein the first control signal line is configured to be written with a reverse signal of the first light emitting control signal or a second scan signal in a scan period of one frame image.

11. The pixel driving circuit of claim 9, wherein the data write sub-circuit comprises a fourth transistor; and a first electrode of the fourth transistor is connected to a data line, a second electrode of the fourth transistor is connected to the first electrode of the driving transistor, and a control electrode of the fourth transistor is connected to a first scan line.

12. The pixel driving circuit of claim 9, wherein the first light emitting control sub-circuit comprises: a fifth transistor; and a first electrode of the fifth transistor is connected to a first power voltage line, a second electrode of the fifth transistor is connected to the first electrode of the driving transistor, and a control electrode of the fifth transistor is connected to a first light emitting control line.

13. The pixel driving circuit of claim 9, wherein the second light emitting control sub-circuit comprises: a sixth transistor; and a first electrode of the sixth transistor is connected to the second electrode of the driving transistor, a second electrode of the sixth transistor is connected to the first electrode of the light emitting device to be driven, and a control electrode of the sixth transistor is connected to a second light emitting control line.

14. The pixel driving circuit of claim 9, wherein the reset sub-circuit comprises: a seventh transistor; and a first electrode of the seventh transistor is connected to the first electrode of the light emitting device to be driven, a second electrode of the seventh transistor is connected to an initialization signal line, and a control electrode of the seventh transistor is connected to a reset signal line.

15. The pixel driving circuit of claim 9, wherein the storage sub-circuit comprises: a storage capacitor; and a first electrode plate of the storage capacitor is connected to the control electrode of the driving transistor, and a second electrode plate of the storage capacitor is connected to a first power voltage line.

16. The pixel driving circuit of claim 9, wherein the data write sub-circuit comprises a fourth transistor; and a first electrode of the fourth transistor is connected to a data line, a second electrode of the fourth transistor is connected to the first electrode of the driving transistor, and a control electrode of the fourth transistor is connected to a first scan line;

wherein the first light emitting control sub-circuit comprises: a fifth transistor; and a first electrode of the fifth transistor is connected to a first power voltage line, a second electrode of the fifth transistor is connected to the first electrode of the driving transistor, and a control electrode of the fifth transistor is connected to a first light emitting control line;

wherein the second light emitting control sub-circuit comprises: a sixth transistor; and a first electrode of the sixth transistor is connected to the second electrode of the driving transistor, a second electrode of the sixth transistor is connected to the first electrode of the light emitting device to be driven, and a control electrode of the sixth transistor is connected to a second light emitting control line;

wherein the reset sub-circuit comprises: a seventh transistor; and a first electrode of the seventh transistor is connected to the first electrode of the light emitting device to be driven, a second electrode of the seventh transistor is connected to an initialization signal line, and a control electrode of the seventh transistor is connected to a reset signal line; and wherein the storage sub-circuit comprises: a storage capacitor; and a first electrode plate of the storage capacitor is connected to the control electrode of the driving transistor, and a second electrode plate of the storage capacitor is connected to a first power voltage line.

17. A display panel comprising a plurality of pixel driving circuits, each of which is the pixel driving circuit of claim 9.

18. The display panel of claim 17, wherein the pixel driving circuits are arranged in an array;

for the pixel driving circuits located in a same row, respective data write sub-circuits are connected to a same first scan line; respective first light emitting control sub-circuits are connected to a same first light emitting control line, respective second light emitting control sub-circuits are connected to a same second light emitting control line, and the gates of the first transistors in respective auxiliary function sub-circuits are connected to a same first control signal line; respective reset sub-circuits are connected to a same reset signal line; the sources of the first transistors in respective auxiliary function sub-circuits are connected to a same second scan line;

for the pixel driving circuits in a same column, respective data write sub-circuits are connected to a same data line; respective first light emitting control sub-circuits and respective storage sub-circuits are connected to a same first power signal line; respective reset sub-circuits are connected to a same initialization signal line;

the first scan line connected to the pixel driving circuits in the (N+1)th row is multiplexed as the second scan line and the reset signal line connected to the pixel driving circuits in the Nth row; the first light emitting control line connected to the pixel driving circuits in the (N+1)th row is multiplexed as the second light emitting control line connected to the pixel driving circuits in the Nth row; N is an integer greater than or equal to 1.

19. The display panel of claim 18, wherein the first scan line to which the pixel driving circuits in the (N+1)th row are connected is further multiplexed as the first control signal line to which the pixel driving circuits in the Nth row are connected.

20. The display panel of claim 17, wherein the first control signal line is configured to be written with a reverse signal of the first light emitting control signal or a second scan signal in a scan period of one frame image.

* * * * *